US012471657B2

(12) United States Patent
Oberhauser et al.

(10) Patent No.: US 12,471,657 B2
(45) Date of Patent: Nov. 18, 2025

(54) TIGHTENING SYSTEM FOR SKI BOOTS

(71) Applicant: BOA Technology, Inc., Denver, CO (US)

(72) Inventors: Isabella Oberhauser, Mondsee (AT); Zachary Hamilton Jensen, Denver, CO (US); Alessandro Manzato, Mondsee (AT); Marco Armiraglio, Mondsee (AT); Brendan Hoskens, Denver, CO (US); Thomas John Pollack, Golden, CO (US); Blake Kittridge, Denver, CO (US); John Coe, Denver, CO (US); Stephen Evans, Denver, CO (US)

(73) Assignee: BOA Technology, Inc., Denver, CO (US)

( * ) Notice: Subject to any disclaimer, the term of this patent is extended or adjusted under 35 U.S.C. 154(b) by 0 days.

(21) Appl. No.: 18/315,340

(22) Filed: May 10, 2023

(65) Prior Publication Data

US 2023/0363488 A1 Nov. 16, 2023

Related U.S. Application Data

(60) Provisional application No. 63/340,876, filed on May 11, 2022.

(51) Int. Cl.

| | |
|---|---|
| ***A43B 5/04*** | (2006.01) |
| ***A43C 11/16*** | (2006.01) |
| ***A43C 11/20*** | (2006.01) |

(52) U.S. Cl.

CPC ..... *A43B 5/0447* (2013.01); *A43B 5/0439* (2013.01); *A43C 11/165* (2013.01); *A43C 11/20* (2013.01)

(58) Field of Classification Search

CPC ..... A43C 11/20; A43C 11/165; A43B 5/0447

See application file for complete search history.

(56) References Cited

U.S. PATENT DOCUMENTS

| | | | |
|---|---|---|---|
| 9,259,056 | B2 | 2/2016 | Soderberg et al. |
| 9,770,070 | B2 | 9/2017 | Cotterman et al. |
| 10,842,230 | B2 | 11/2020 | Pollack et al. |

(Continued)

FOREIGN PATENT DOCUMENTS

| | | | |
|---|---|---|---|
| EP | 2881005 | A1 | 6/2015 |
| EP | 3192386 | B1 | 7/2017 |

(Continued)

*Primary Examiner* — Ted Kavanaugh

(74) *Attorney, Agent, or Firm* — Kilpatrick Townsend & Stockton LLP

(57) ABSTRACT

A tightening device for tightening a ski boot includes an elongate panel having a proximal end and a distal end. The elongate panel is positioned about the ski boot's shell between opposing sides of the shell. A tensioning mechanism is coupled with the proximal end of the elongate panel. A tension member is operably coupled with the tensioning mechanism so that an operation of the tensioning mechanism adjusts a tension of the tension member. At least one guide member is coupled with, or positioned on, the proximal end of the elongate panel adjacent to the tensioning mechanism. The tension member is coupled with the guide member to route or direct the tension member between the opposing sides of the shell and along a portion of the elongate panel.

23 Claims, 16 Drawing Sheets

(56) References Cited

U.S. PATENT DOCUMENTS

Figure 1A:
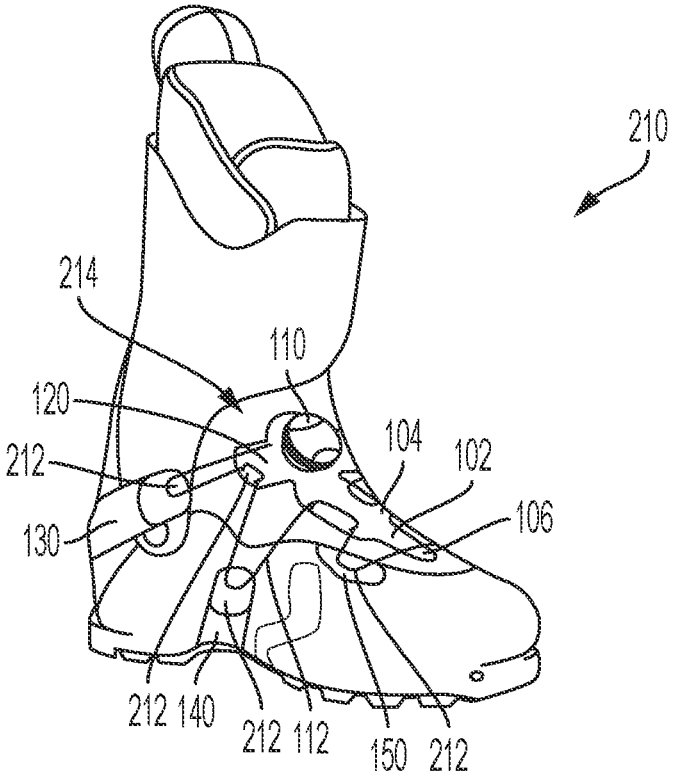

| | | | | |
|---|---|---|---|---|
| 2014/0208550 | A1* | 7/2014 | Neiley | A43C 7/00<br>24/712.1 |
| 2014/0290016 | A1* | 10/2014 | Lovett | A43B 19/005<br>242/378.1 |
| 2015/0096202 | A1* | 4/2015 | Hahnenberger | A43B 23/027<br>36/114 |
| 2015/0342302 | A1* | 12/2015 | Hahnenberger | A43C 11/165<br>24/68 SK |
| 2017/0202297 | A1* | 7/2017 | Parisotto | A43B 5/0447 |

FOREIGN PATENT DOCUMENTS

| | | | |
|---|---|---|---|
| IT | 20110013 | A1 | 8/2012 |
| WO | 2014/093913 | A1 | 6/2014 |

* cited by examiner

TIGHTENING SYSTEM FOR SKI BOOTS

CROSS-REFERENCE TO RELATED APPLICATIONS

This application claims priority to Provisional U.S. Patent Application No. 63/340,876, filed May 11, 2022, entitled "Tightening System for Ski Boots," the entire disclosure of which is hereby incorporated by reference, for all purposes, as if fully set forth herein.

BACKGROUND

Articles, such as shoes, boots, and other footwear, employ various mechanism that are designed to close and tighten the article. Some articles include materials that are relatively rigid and somewhat difficult to close and tighten. For example, ski boots, such as alpine ski boots, typically have exterior shells that are made of rigid materials, such as various polymers. The exterior shells are often difficult to close about a user's leg and foot due to the rigid materials that are employed. It is also often difficult to make the ski boot comfortable to wear due to the rigid materials that are employed. A proper balance between comfort and fit is desired in ski boots, but may be difficult to achieve due the use of rigid materials and other design constraints. Conventional closure devices that are employed to close ski boots often tighten the ski boot in relatively large increments, which may add a degree of complexity in achieving a proper balance between fit and comfort. Other articles, such as shoes, may include relatively soft materials that are significantly easier to close. Improved devices and mechanisms for closing various articles are desired.

BRIEF DESCRIPTION

The embodiments described herein are related to devices and components that may be used for ski boots to achieve an improved balance between comfort and fit. The described components include tightening systems, internal harnesses, guide members, elongate panels, straps, panels, etc. Although the components are described as being used for ski boots, it should be realized that various other applications of the components are envisioned, such as use with other types of footwear (e.g., shoes, work boots, etc.), articles of clothing, accessories (backpacks, bags, etc.), and the like. Accordingly the any of the components described herein, or any combination of components, may be claimed for use with other articles or another article may be substituted for the described ski boot.

According to one aspect, a tightening device for tightening a ski boot includes an elongate panel having a proximal end and a distal end. The elongate panel is positionable about a shell of the ski boot between opposing sides of the shell. A tensioning mechanism is coupled with the proximal end of the elongate panel and a tension member is operably coupled with the tensioning mechanism so that an operation of the tensioning mechanism adjusts a tension of the tension member. At least one guide member is coupled with, or positioned on, the proximal end of the elongate panel adjacent the tensioning mechanism. The tension member is coupled with the at least one guide member so that the tension member is routed between the opposing sides of the shell and along a portion of the elongate panel.

In some instances, the at least one guide member includes a first guide member that is positioned on a first side of the elongate panel and a second guide member that is positioned on a second side of the elongate panel opposite the first side. The first guide member and the second guide member may be positioned on arms or tabs that extend laterally from opposing sides of the proximal end of the elongate panel. The elongate panel may also include another guide member that is positioned along the elongate panel between the proximal end and a distal end of the elongate panel. In such instances, the elongate panel may be laterally wider or flared adjacent the guide member positioned along the elongate panel. The tension member may be routed longitudinally along a center portion of the elongate panel via this additional guide member so that the tension member does not cross itself along the central portion of the elongate panel.

In some instances, the tension member may be operably coupled with one or more straps, panels, or material segments that are positioned under an outer shell of the ski boot and that engage a liner of the ski boot. The straps, panels, or material segments may form or define an internal harness that is positioned under the outer shell of the ski boot. The proximal end of the elongate panel may include an annular ring that is positioned above the elongate panel to allow a gaiter of the ski boot to be positioned between the elongate panel and the annular ring. In such instances, at least a portion of the proximal end of the elongate panel may curve downward to accommodate placement of the gaiter between the elongate panel and the annular ring.

In some instances, the elongate panel may include a flexible member or zone that connects the proximal end of the elongate panel to a distal end of the elongate panel. The flexible member or zone may allow the proximal end of the elongate panel to bend and flex relative to the distal end. In such instances, the flexible member or zone may be a thin material section, a hinge, a kerf section, and the like. The elongate panel may not be attached to the shell other than via the tension member. The tensioning mechanism may be removably coupled with the proximal end of the elongate panel. The proximal end of the elongate panel may be substantially wider and thicker than the distal end of the elongate panel.

According to another aspect, a method of coupling a tightening device with a shell of a ski boot includes providing a tightening device that includes an elongate panel having a proximal end and a distal end, a tensioning mechanism that is coupled with the proximal end of the elongate panel, a tension member that is operably coupled with the tensioning mechanism, and at least one guide member that is coupled with the proximal end of the elongate panel. The tightening device is positioned between opposing sides of the shell, the tension member is attached to a first guide on a first side of the shell, and the tension member is also attached to a second guide on a second side of the shell.

In some instances, the at least one guide member includes a first guide member that is positioned on a first side of the elongate panel and a second guide member that is positioned on a second side of the elongate panel opposite the first side. The first guide member and the second guide member may be positioned on arms or tabs that extend laterally from opposing sides of the proximal end of the elongate panel. The elongate panel further may include another guide member that is positioned along the elongate panel between the proximal end and a distal end of the elongate panel and the tension member may be routed longitudinally along a center portion of the elongate panel via this guide member. In such instances, the tension member may not cross itself along the central portion of the elongate panel.

The tension member may be operably coupled with one or more straps, panels, or material segments that are positioned under an outer shell of the ski boot and that engage a liner of the ski boot. In such instances, the straps, panels, or material segments may form or define an internal harness that is positioned under the outer shell of the ski boot. The proximal end of the elongate panel may include an annular ring that is positioned above the elongate panel to allow a gaiter of the ski boot to be positioned between the elongate panel and the annular ring. The elongate panel may also or alternatively include a flexible member or zone that connects the proximal end of the elongate panel to a distal end of the elongate panel. The flexible member or zone may allow the proximal end of the elongate panel to bend and flex relative to the distal end. The elongate panel may not be attached to the shell other than via the tension member. The tensioning mechanism may be removably coupled with the proximal end of the elongate panel and/or the proximal end of the elongate panel may be substantially wider and thicker than the distal end of the elongate panel.

According to another aspect, a ski boot includes an outer shell, an inner liner, a tensioning mechanism, a tension member that is operably coupled with the tensioning mechanism so that an operation of the tensioning mechanism adjusts a tension of the tension member, and at least one guide member that is coupled with the tension member to route or direct the tension member between opposing sides of the outer shell. The ski boot also includes one or more straps, panels, or material segments that are positioned under the outer shell and that engage the liner of the ski boot. The tension member is operably coupled with the one or more straps, panels, or material segments such that tensioning the tension member tightens the one or more straps, panels, or material segments against a wearer's foot.

In some instances, the one or more straps, panels, or material segments form or define an internal harness that is positioned under the outer shell of the ski boot. The one or more straps, panels, or material segments may include a strap or panel that is positioned around a heel portion of the ski boot and/or a strap or panel that is positioned under a foot portion of the ski boot. The strap or panel positioned around the heel portion may be connected to the strap or panel positioned under the foot portion. The ski boot may also include an elongate panel having a proximal end and a distal end. The elongate panel may be positioned about a shell of the ski boot between opposing sides of the shell and the tensioning mechanism may be coupled with the proximal end of the elongate panel.

According to another aspect, a method of constructing a ski boot includes providing a ski boot having an outer shell and an inner liner and coupling a tensioning mechanism with the ski boot. A tension member is coupled with the tensioning mechanism so that an operation of the tensioning mechanism adjusts a tension of the tension member. At least one guide member is coupled with the ski boot and the tension member so that the tension member is routed or directed between opposing sides of the outer shell. One or more straps, panels, or material segments are positioned under the outer shell so that the one or more straps, panels, or material segments engage the liner of the ski boot and the tension member is coupled with the one or more straps, panels, or material segments so that tensioning the tension member tightens the one or more straps, panels, or material segments against a wearer's foot.

The one or more straps, panels, or material segments may form or define an internal harness that is positioned under the outer shell of the ski boot. The one or more straps, panels, or material segments may include a strap or panel that is positioned around a heel portion of the ski boot and/or a strap or panel that is positioned under a foot portion of the ski boot. The strap or panel that is positioned around the heel portion may be connected to the strap or panel positioned under the foot portion. The ski boot may also include an elongate panel that is positioned about a shell of the ski boot between opposing sides of the shell. The tensioning mechanism may be coupled with a proximal end of the elongate panel.

According to another aspect, a guide for routing or directing a tension member about a path of an article includes a main body having a proximal end, a distal end, a first side, and a second side. The guide also includes a lace channel that is positioned on the distal end of the main body and that extends through the main body. The lace channel has a first opening positioned near the first side of the main body and a second opening positioned near the second side of the main body. The proximal end of the main body includes a first attachment feature for attaching the main body to the article via a first attachment means and a second attachment feature for attaching the main body to the article via a second attachment means. The first attachment means is different than the second attachment means and the tension member is insertable through the first opening, the second opening, and the lace channel to route or direct the tension member about the path of the article.

The first attachment feature may be configured for a first type of mechanical fastener and the second attachment feature may be configured for a second type of mechanical fastener. The first attachment feature may be a thru hole for a bolt, rivet, etc. and/or the second attachment feature may be a thin section of material that is stitchable to the article. The guide may be configured so that a portion of the main body associated with the first attachment feature is removable from the main body. In such instances, a length of the guide is shortened.

The guide may also include a haptic feature that is positioned adjacent to at least one of the first opening or the second opening to aid a user in locating the first opening or the second opening. The haptic feature may be, or include, one or more ribs that are positioned on at least one of an upper surface or lower surface of the main body adjacent to the at least one of the first opening or the second opening. The one or more ribs may be positioned adjacent to both the first opening and the second opening and/or the one or more ribs may be positioned on both the upper surface and the lower surface of the main body adjacent to the at least one of the first opening or the second opening.

According to another aspect, a guide for routing or directing a tension member about a path of an article includes a main body having a proximal end, a distal end, a first side, and a second side, in which the proximal end is configured for coupling with the article. The guide also includes a lace channel that is positioned on the distal end of the main body. The lace channel extends through the main body and has a first opening positioned near the first side of the main body and a second opening positioned near the second side of the main body. The guide further includes a haptic feature that is positioned adjacent to at least one of the first opening or the second opening to aid a user in locating the first opening or the second opening. The tension member is insertable through the first opening, the second opening, and the lace channel to route or direct the tension member about the path of the article.

The haptic feature may be, or include, one or more ribs that are positioned on at least one of an upper surface or lower surface of the main body adjacent to the at least one of the first opening or the second opening. The one or more ribs may be positioned adjacent to both the first opening and the second opening and/or the one or more ribs may be positioned on both the upper surface and the lower surface of the main body adjacent to the at least one of the first opening or the second opening.

The proximal end of the main body may include a first attachment feature for attaching the main body to the article via a first attachment means and a second attachment feature for attaching the main body to the article via a second attachment means, in which the first attachment feature is different than the second attachment feature. The first attachment feature may be configured for a first type of mechanical fastener and the second attachment feature may be configured for a second type of mechanical fastener. The first attachment feature may be a thru hole for a bolt, rivet, other mechanical fastener, etc. and/or the second attachment feature may be a thin section of material that is stitchable to the article. The guide may be configured so that a portion of the main body associated with the first attachment feature is removable from the main body.

DETAILED DESCRIPTION OF THE INVENTION

The embodiments described herein relate to tightening systems that are configured for tightening an article. The tightening systems may be specially configured for tightening alpine or ski boots, or other articles that include relatively rigid shells or outer materials. For ease in describing the embodiments, the tightening systems will be generally described as being used with ski boots, although it should be understood that the tightening systems may be used to tighten other articles. The tightening systems include a panel that is coupled with a reel based closure device. The reel based closure device is configured to tension a lace or tension member that is guided about the ski boot via one or more guide members, which may be rigid components that are made of plastic or other materials, or which may be flexible and soft components that are made of fabric materials.

The reel based devices typically include a knob or dial that may be grasped and rotated by a wearer. The knob or dial is commonly coupled with a spool around which the tension member or lace is wound in response to rotation of the knob or dial in a tightening direction. Rotation of the tension member or lace around the spool tensions the tension member or lace, which tightens the ski boot about a wearer's foot by constricting the shell and/or any internal components (i.e., a liner, etc.) about the wearer's foot. Exemplary reel based devices are further described in U.S. patent application Ser. No. 14/297,047 filed Jun. 5, 2017, and entitled "Integrated Closure Device Components and Methods", and in U.S. Pat. No. 9,259,056, filed Jun. 21, 2013, and entitled "Reel Based Lacing System", the entire disclosures of which are incorporated by reference herein.

The reel based devices described herein may replace traditional buckles and/or other tightening systems that are commonly used on ski boots to tighten the ski boot about a wearer's foot. The reel based devices are significantly easier to operate than traditional buckles and/or other tightening systems. As such, wearer's may greatly prefer reel based devices in tightening a ski boot. In addition, reel based devices offer significantly more degrees or increments of tightening and loosening of the ski boot in comparison with traditional buckles and/or other tightening systems. For example, traditional buckles and/or other tightening systems often include a limited number of tightening segments (e.g., teeth, steps, racks, and the like). For example, traditional buckles often employ 5 to 10 teeth on a rack within which an engagement pin is positioned to tighten the ski boot. The engagement pin is moved laterally about the rack and positioned within a respective tooth in order to increase or decrease the tightness of the ski boot about the foot. The limited number of tightening segments (e.g., teeth) results in the ski boot being tightened or loosened by greater amounts or increments and thus, it may be difficult to achieve a desired and comfortable fit.

In contrast, reel based devices are capable of tightening and/or loosening the ski boot by significantly smaller increments or degrees. For example, if a minor increase in tightness is desired, the knob of the reel based device may be rotated by a quarter turn, an eighth of a turn, or less to slightly increase tension in the tension member. The slight increase in the tension member's tension normally results in a slight increase in the tightness or constriction of the ski boot about the wearer's foot. This incremental adjustment of the ski boot's tightness may allow a desired and comfortable fit of the ski boot to be easily achieved.

Figure 1B:
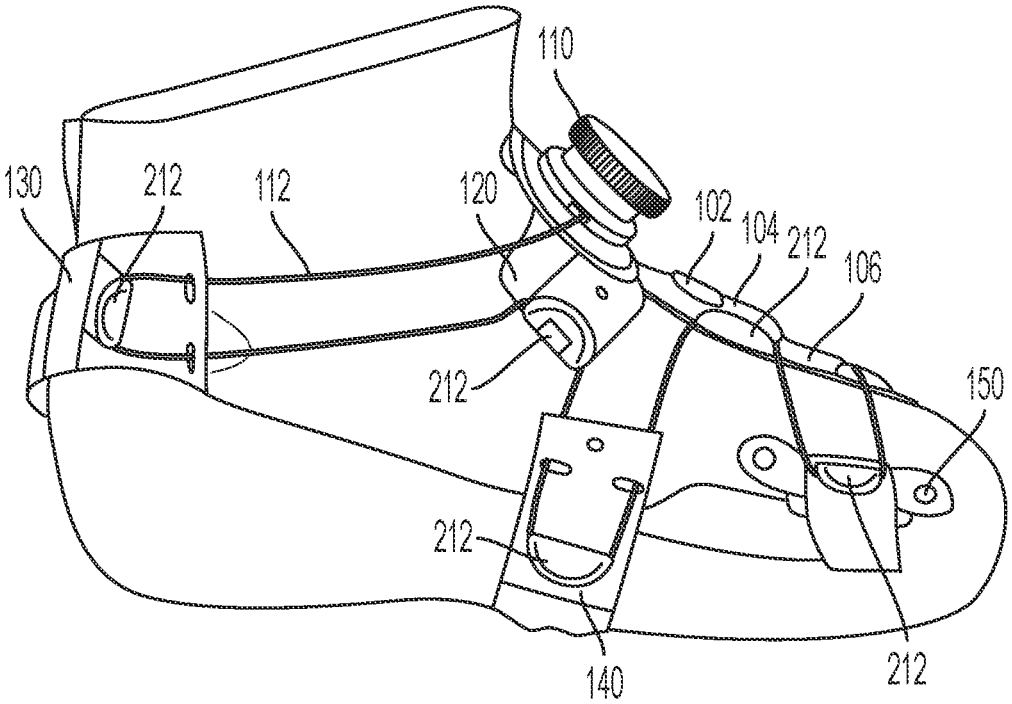

Referring to FIGS. 1A-B, illustrated is an elongate panel 102 that may be used to tighten a ski boot 210. The elongate panel 102 may be positioned within a longitudinal opening 214 (hereinafter longitudinal opening 214) of a ski boot 210. The elongate panel 102 is positionable longitudinally within the longitudinal opening 214 of the ski boot 210. The elongate panel 102 is typically aligned with opposing sides of the longitudinal opening 214 and is also typically centered laterally within the longitudinal opening 214 as illustrated in FIG. 1A.

The elongate panel 102 is coupled with opposing sides of the longitudinal opening 214 so that operating a reel based closure device 110 pulls the opposing sides of the longitudinal opening 214 toward one another to close the ski boot about a wearer's foot. A proximal or upper end of the elongate panel 102 includes arms or tabs 120 that extend laterally from opposing sides of the proximal end. The arms or tabs 120 extend toward the opposing sides of the longitudinal opening 214 and in some instances may extend fully to the opposing sides of the longitudinal opening 214. A guide member 212 is coupled with the distal end of each arm or tab 120. Each guide member 212 is configured to route or guide a tension member 112 along a lace path.

The reel based closure device 110 is also typically attached to the proximal end of the elongate panel 102. In some embodiments, the elongate panel 102 may include a bayonet or housing located at the proximal end that allows the reel based closure device 110 to be removably coupled with the elongate panel 102. The tension member 112 is attached to the reel based closure device 110. The tension member 112 is tensionable by the reel based closure device 110 as described in the applications incorporated by reference herein.

A midsection 104 of the elongate panel 102 also includes one or more guide members 212 that are configured to route or direct the tension member 112 along the lace path. The guide members 212 are coupled with opposing ends of the midsection 104 of the elongate panel 102 and are arranged or oriented so that the tension member 112 is guided or directed toward the respective opposing side of the ski boot. The guide members 212 that are coupled with the midsection 104 may have a longitudinal length that is greater than a longitudinal length of the guide members 212 attached to each arm or tab 120. In other instances, the guide members 212 that are coupled with the midsection 104 may be formed or defined by separate components that functions together to guide or direct the tension member 112. In yet other instances, a single guide member 212 may be used in place of the guide members 212 that are coupled with the opposing ends of the midsection 104. The single guide member 212 may have opposing channels or openings that route or direct the tension member 112 to the respective opposing sides of the longitudinal opening 214.

The midsection 104 of the elongate panel 102 may be laterally wider or flared in comparison with a portion of the elongate panel 102 that is proximal and/or distal to the midsection 104. For example, as illustrated in FIG. 1A, the portion of the elongate panel 102 that is positioned proximally of the midsection 104 may narrow or taper slightly between the midsection 104 and the arms or tabs 120. The widened midsection 104 may function to accommodate the guide members 212 that are positioned on the midsection 104 of the elongate panel 102.

A distal end 106 of the elongate panel 102 extends toward the distal end of the longitudinal opening 214. In some instances, the distal end 106 of the elongate panel 102 may narrow substantially in comparison with the midsection 104 of the elongate panel 102. In other instances, the distal end 106 of the elongate panel 102 may be omitted so that the elongate panel 102 terminates at a distal end of the midsection 104. The distal end 106 may include a centrally located guide member (not shown) that functions to guide or direct the tension member 112 across the distal end 106 of the elongate panel 102.

The ski boot 210 also includes one or more additional components that function with the elongate panel 102 to close and tighten the ski boot 210 about a wearer's leg in a desired manner. The additional components are typically separate from the elongate panel 102 and are positionable or coupleable with the ski boot 210 so that the components engage with the tension member 212 and close or tighten an area of the ski boot 210. In some instances, the additional components are straps, panels, or material segments that wrap or extend around the ski boot 210 and functionally engage with the opposing sides of the elongate panel. The straps, panels, or material segments are typically positioned under an outer shell of the ski boot 210 so that the straps, panels, or material segments contact or engage a liner of the ski boot 210. The straps, panels, or material segments form or define an internal harness when positioned under the outer shell of the ski boot 210. Tensioning the straps, panels, or material segments pulls these components into increased contact or engagement with the liner, which tightens or constricts the liner about the wearer's leg and/or foot.

In the illustrated embodiment, the ski boot 210 includes an upper strap 130 and a mid-strap 140 that functionally operate or engage with the elongate panel 102. The upper strap 130 is positioned or coupled with the ski boot 210 so that the upper strap 130 extends around a heel portion of the ski boot 210. The upper strap 130 may be positioned slightly above the heel of the ski boot 210 near an ankle pivot joint of the ski boot 210. Opposing distal ends of the upper strap 130 include a guide member 212 that is configured to route or direct the tension member 112 along the lace path. The guide member 212 of the upper strap 130 typically routes or directs the tension member 112 to the guide member 212 positioned on the arm or tab 120. In a specific instance, the tension member 112 may be routed directly from the reel based closure device 110 to the guide member 212 on the upper strap 130. The tension member 112 may be routed from the guide member 212 on the upper strap 130 to the guide member 212 on the arm or tab 120.

The mid-strap 140 is positioned or coupled with the ski boot 210 so that the mid-strap 140 extends under the liner of the ski boot 210. The mid-strap 140 may be positioned near a footbed of the ski boot 210. Opposing distal ends of the mid-strap 140 include a guide member 212 that is configured to route or direct the tension member 112 along the lace path. The guide member 212 of the mid-strap 140 typically routes or directs the tension member 112 to the guide member 212 positioned on the midsection 104 of the elongate panel 102. In a specific instance, the tension member 112 is routed from the guide member 212 on the arm or tab 120 to the guide member 212 on the mid-strap 140. The tension member 112 is routed therefrom to the guide member 212 positioned on the midsection 104 of the elongate panel 102.

The ski boot 210 may also include one or more lower panels or straps 150 that are positioned nearer to the distal end of the longitudinal opening 214 than the upper strap 130 and the mid-strap 140. The lower panel(s) 150 is also typically positioned nearer to the distal end of the longitudinal opening 214 than the guide member 212 of the midsection 104 of the elongate panel 102. In some instances, the lower panel 150 may be a single component that wraps around the liner near a distal end of the toe box. In other instances, separate lower panels 150 may be positioned on each opposing side of the longitudinal opening 214. In such instances, the lower panels 150 may be attached to the ski boot 210 via rives, adhesives, mechanical fasteners, welding, and the like. For ease in describing the illustrated embodiments, the ski boot 210 will be described as including separate lower panels 150.

Each lower panel 150 includes a guide member 212 that is configured to route or direct the tension member 112 along the lace path. The guide member 212 of the lower panel 150 receives the tension member 112 from the guide member 212 positioned on the midsection 104 of the elongate panel 102 and routes or directs the tension member 112 laterally across the longitudinal opening 214 of the ski boot 210. In some instances, the tension member 112 crosses and is positioned atop the distal end 106 of the elongate panel 102. In such instances, the distal end 106 of the elongate panel 102 may include a guide member, or guide members, that facilitate in routing the tension member 112 across the longitudinal opening 214. In other instances, the distal end 106 of the elongate panel 102 may be omitted and the tension member 112 may be routed directly between the opposing lower panels 150.

In some embodiments, the lace path of the tension member 112 may be designed so that the tension member 112 is routed along one side of the elongate panel 102 and ski boot 210 and only crosses the longitudinal opening 214 a single time. For example, as illustrated in FIG. 1A, the tension member 112 is routed from the reel based closure device 110 to the guide members 212 positioned respectively on the upper strap 130, the arm or tab 120, the mid-strap 140, the midsection 104, and the lower panel 150. Along this portion of the lace path, the tension member 112 does not cross or traverse the entire width of the longitudinal opening 214 between the reel based closure device 110 and the lower panel 150. Rather, the tension member 112 only crosses or traverses the entire width of the longitudinal opening 214 as it is routed from one of the lower panels 150 to the other lower panel 150 positioned on the opposing side of the longitudinal opening 214. In some instances, the tension member 112 may terminate at the lower panel 150. In such instances, the tension member 112 may never cross or traverse the entire width of the longitudinal opening 214 along the entire lace path.

In some embodiments, the guide members 212 positioned on the elongate panel 102 may be positioned on a bottom side of the elongate panel 102 so that they are concealed or covered by the elongate panel 102 and are hidden from view. Similarly, the guide members 212 that are positioned on the upper strap 130, mid-strap 140, and/or lower panel 150 may be positioned under the exterior shell of the ski boot 210 so as to be hidden from view. In some instances, a gaiter or covering (not shown) may be positioned in the longitudinal opening 214 over or under the elongate panel 102. The gaiter may protect the wearer's foot and/or the tension member 112 and guide members 212.

The elongate panel 102 may be made from various plastic or polymer materials, or any other suitable material. For example, the elongate panel 102 may be formed of a relatively low friction polymer material so as to create a low friction surface upon which the tension member 112 slides. This may allow the tension member 112 to more easily facilitate in closing the longitudinal opening 214 of the ski boot 210. The elongate panel 102 may be generally free-floating within the longitudinal opening 214 of the ski boot 210. In other embodiments, the elongate panel 102, or any portion thereof, may be fixedly fastened to the ski boot 210, such as by affixing the distal end 106 of the elongate panel 102 to the distal end of the longitudinal opening 214. In such instances, the elongate panel 102 may be attached to the ski boot 210 shell (e.g., near the toe box) by sewing, adhesively bonding, welding, mechanically fastening, etc. In some embodiments, the elongate panel 102, or a portion thereof, may be molded into the shell of the ski boot 210.

Figure 2:
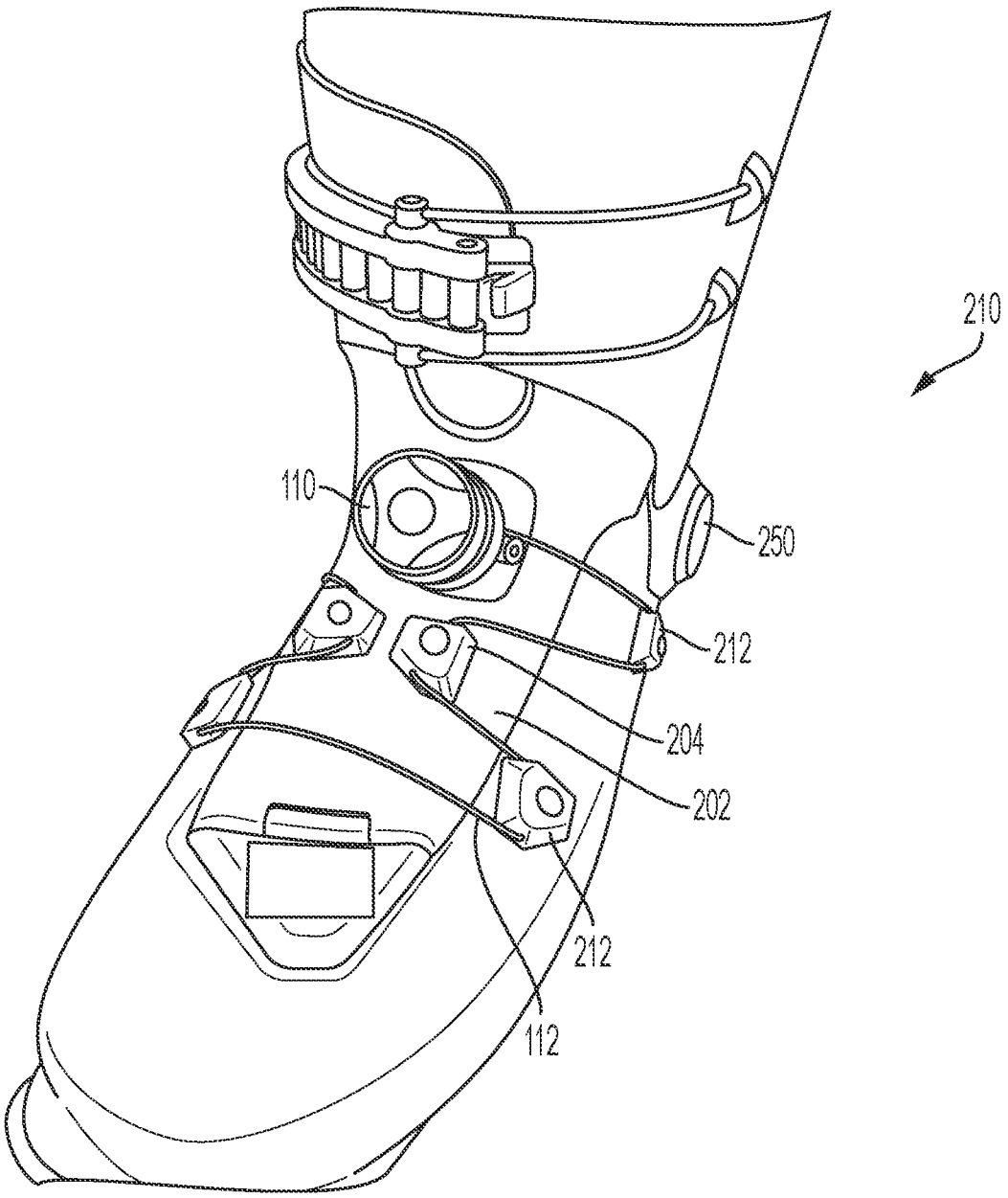

FIG. 2 illustrates an embodiment of a panel 202 that is positioned on exterior of, or atop, the shell of the ski boot 210. The panel 202 includes a reel based closure device 110 and one or more guide members 204 as previously described. The panel 202 may have a relatively uniform width and may be positioned over the longitudinal opening 214 of the ski boot 210. The tension member 112 may be routed about the exterior of the ski boot 210 via one or more guides 212 that are coupled with the ski boot 210. The one or more guides 212 may be directly coupled with the ski boot 210, via riveting, mechanical fastening, adhesive bonding, etc., or indirectly coupled with the ski boot, such as by positioning the guide 212 on a strap, panel, or material component.

FIG. 2 also illustrates that the reel based closure device 110 is positioned on the panel 202 so that the reel based closure device 110 is positioned slightly above an ankle flex zone of the ski boot 210. For example, the reel based closure device 110 may be positioned vertically above an ankle pivot joint 250 of the ski boot 210. Although not specifically illustrated in FIGS. 1A-B, the reel based closure device 110 illustrated in those figures is also typically positioned vertically above the ankle pivot joint of the ski boot 210. In both embodiments, the reel based closure device 110 may be detachable from the panel 202. In such instances, a base member or bayonet may be attached to the respective panel 102/202. The base member or bayonet may be designed to easily attach with and detach from a housing of the reel based closure device 110. The base member or bayonet may be positioned on the panel 102/202 so that the reel based closure device 110 is oriented above the ankle pivot joint of the ski boot 210.

FIGS. 3-7 illustrate embodiments of ski boots that include elongate panels and guides that are positioned on the interior of the ski boot. In some embodiments, the elongate panels and guides may be positioned in between the outsole and midsole of the ski boot. In other embodiments, the elongate panels and guides may be positioned on top of the midsole. The midsole and/or one or more components of the elongate panels and guides may be formed of rigid or non-rigid materials as desired.

Figure 3:
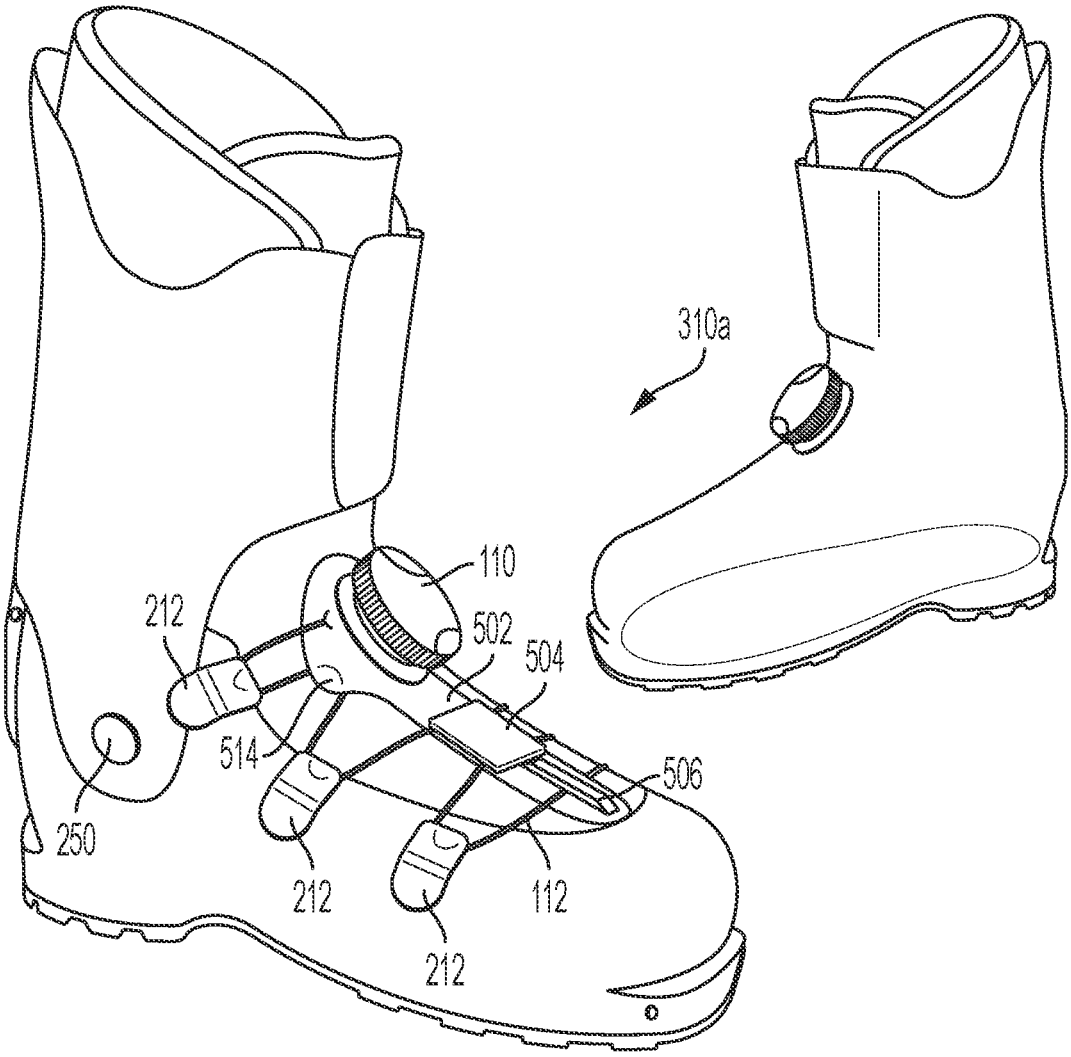

Referring to FIG. 3, illustrated is a ski boot 310*a* that includes an elongate panel 502 that is used to tighten the ski boot 310*a*. The elongate panel 502 is positionable longitudinally within a longitudinal opening of the ski boot 310*a* as previously described. The elongate panel 502 is typically aligned with opposing sides of the longitudinal opening and is also typically centered laterally within the longitudinal opening. The elongate panel 502 may be similar to the panel 102 previously described, or may be similar to the panel illustrated and described in FIGS. 13A-G. The description of panel 502 in FIGS. 13A-G is equally applicable to the ski boot of FIG. 3, but is excluded from the description of FIG. 3 for purposes of brevity.

The elongate panel 502 includes a reel based closure device 110 that is operable in the manner previously described to pull opposing sides of the ski boot's longitudinal opening toward one another. The tension member 112 is routed about the ski boot 310*a* via a plurality of guides 212 that are coupled with the ski boot 310*a*. In the specific embodiment, the ski boot 310*a* includes three guides 212 that are positioned on each side of the longitudinal opening. Specifically, the ski boot includes an upper, middle, and lower guide 212 on each side of the ski boot 310*a* that routes the tension member 112 between the elongate panel 502 and the respective side of the ski boot 310*a*. The upper guide 212 routes the tension member 112 between the reel based closure device 110 and an upper guide 514, the middle guide 212 routes the tension member 112 between the upper guide 514 and a guide positioned on the midsection 504, and the lower guide 212 routes the tension member 112 between the midsection guide and through a guide on the distal end 506.

The guides 212 may be directly coupled with the ski boot 310*a*, via riveting, mechanical fastening, adhesive bonding, etc., or indirectly coupled with the ski boot, such as by positioning one or more of the guides 212 on a strap, panel, or material component. FIG. 3 illustrates that the reel based closure device 110 is positioned on the panel 302 so that the reel based closure device 110 is positioned slightly above an ankle pivot joint 250 of the ski boot 210. The upper guide 212 may also be positioned above the ankle pivot joint 250 as illustrated in FIG. 3. The elongate panel 502 and guides 212 are coupled with the ski boot 310*a* so that these components, or at least one of the components, are positioned internally within the ski boot 310*a*. Stated differently, the elongate panel 502 and/or guides 212 are not positioned on the exterior of the ski boot 310*a*. The internal positioning of the components is illustrated in the right hand image of FIG. 3. As illustrated, the only component that is positioned externally of the ski boot 310*a* is the reel based closure device 110, which is positioned in this manner so as to be accessible to the user.

Figure 4:
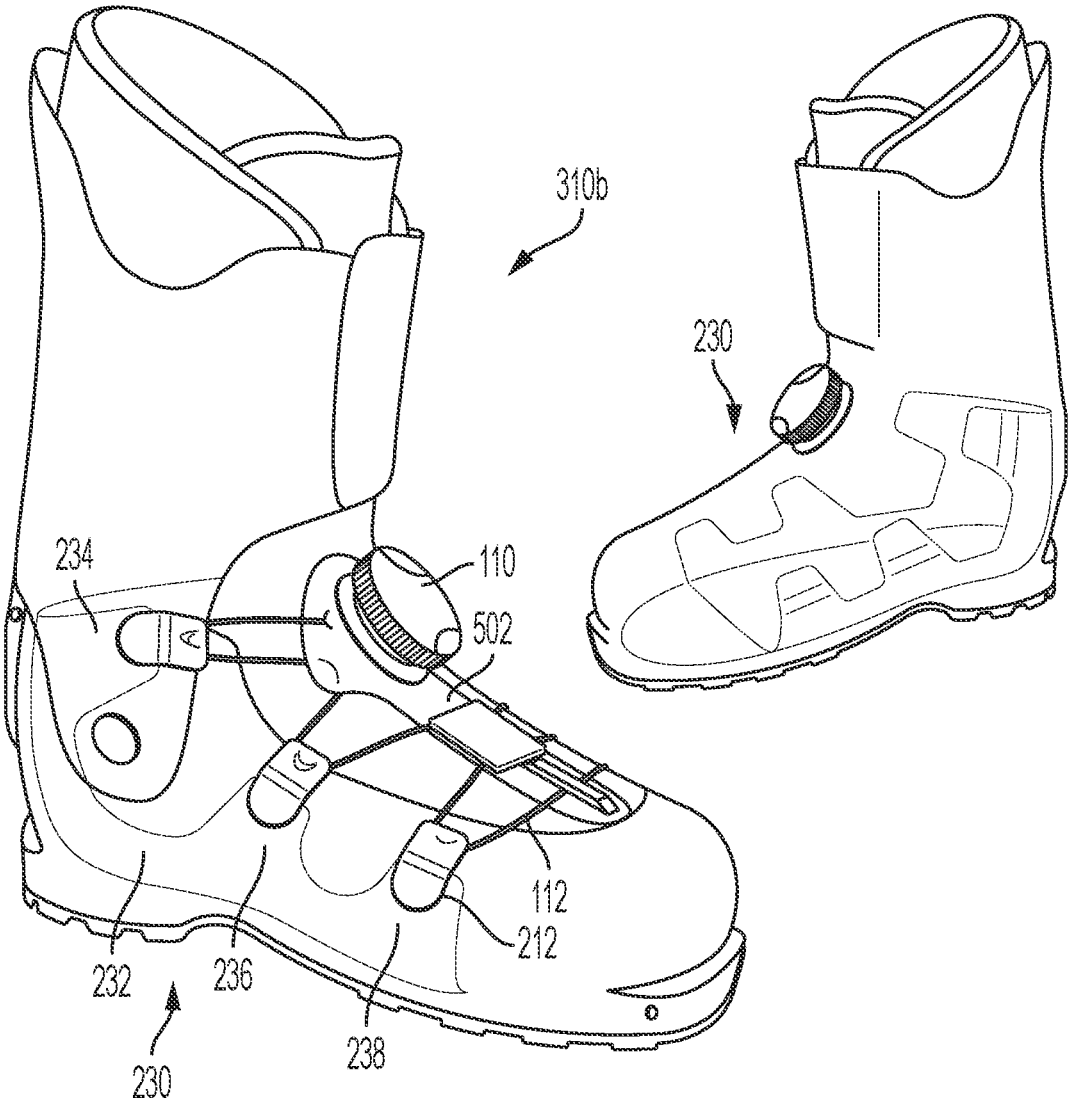

FIG. 4 illustrates a ski boot 310*b* that includes the elongate panel 502 illustrated in FIG. 3. A main difference between the ski boot 310*b* of FIG. 4 and the ski boot 310*a* of FIG. 3 is in the coupling of one or more of the guides 212 with a harness 230 that is positioned within the ski boot 310*b*. The harness 230 is oriented within the ski boot 310*b* so that it is positioned below a wearer's foot, and in some instances, around the wearer's ankle. The harness 230 includes a main body 232 and one or more arms or extensions that attach to an individual guide 212. For example, the main body 232 may include an upper arm 234 that attaches with the upper guide 212, a middle arm 236 that attaches with the middle guide 212, and/or a lower arm 238 that attaches with the lower guide 212. One or more of the arms (234, 236, and 238) may be omitted as desired. Opposing sides of the harness 230 may include the identified arms. The opposing sides of the harness 230 may have a symmetrical or asymmetrical configuration in relation to a longitudinal plane. For example, one side of the harness 230 may include two arms while the opposing side includes three arms.

Attaching the guides 212 to the distal end of the respective arms results in the harness 230 being pulled tightly against the bottom of the wearer's foot as the tension member 112 is tensioned. The harness 230 is typically positioned under a liner that is positioned within the ski boot 310*b*. In such instances, tensioning of the harness 230 results in the liner being pulled into increased contact with the wearer's foot. As the tension member 112 is tensioned, the elongate panel 502 presses the upper portion of the liner into increased contact with the wearer's foot.

Figure 5:
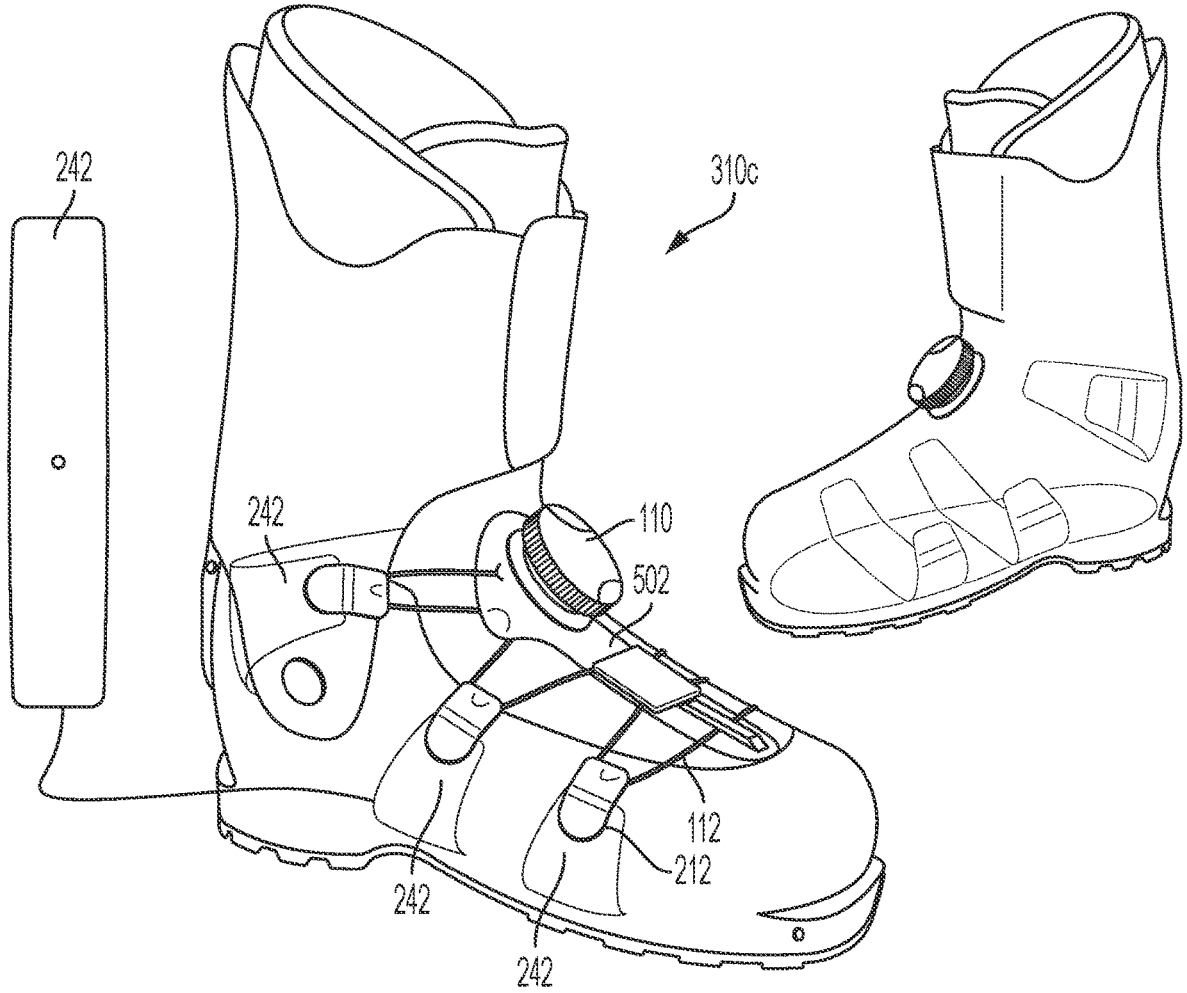

FIG. 5 illustrates a ski boot 310*c* that includes the elongate panel 502 illustrated in FIG. 3. The ski boot 310*c* of FIG. 5 is similar to the ski boot 310*b* of FIG. 4 except that the guides 212 are attached with individual straps 242 rather than with ends of the harness 230. Each strap 242 includes a pair of guides that are attached to opposing ends of the strap 242. The individual straps 242 are positioned within the ski boot 310*c* typically under a liner or layer that contacts the wearer's foot. The ski boot 310*c* may include one or more of the straps 242, such as three straps 242 in the illustrated embodiment. In the illustrated embodiment, two of the straps 242 are oriented within the ski boot 310*c* so as to be positioned below the wearer's foot while a third strap is positioned around the wearer's ankle. Each of the straps 242 may have a main body and a linear orientation or profile. Each strap 242 extends around the wearer's foot from the medial side to the lateral side of the ski boot 310*c*. Attaching the guides 212 to individual straps 242 results in the respective straps 242, or more commonly a liner, being pulled tightly against the wearer's foot as the tension member 112 is tensioned. The use of the individual straps 242 allows the tension applied to various areas of the wearer's foot to be adjusted and tailored as desired. The position of the straps 242 within the ski boot 310*c* can be varied to apply a desired force to the foot. As the tension member 112 is tensioned, the elongate panel 502 presses the upper portion of the liner into increased contact with the wearer's foot.

Figure 6:
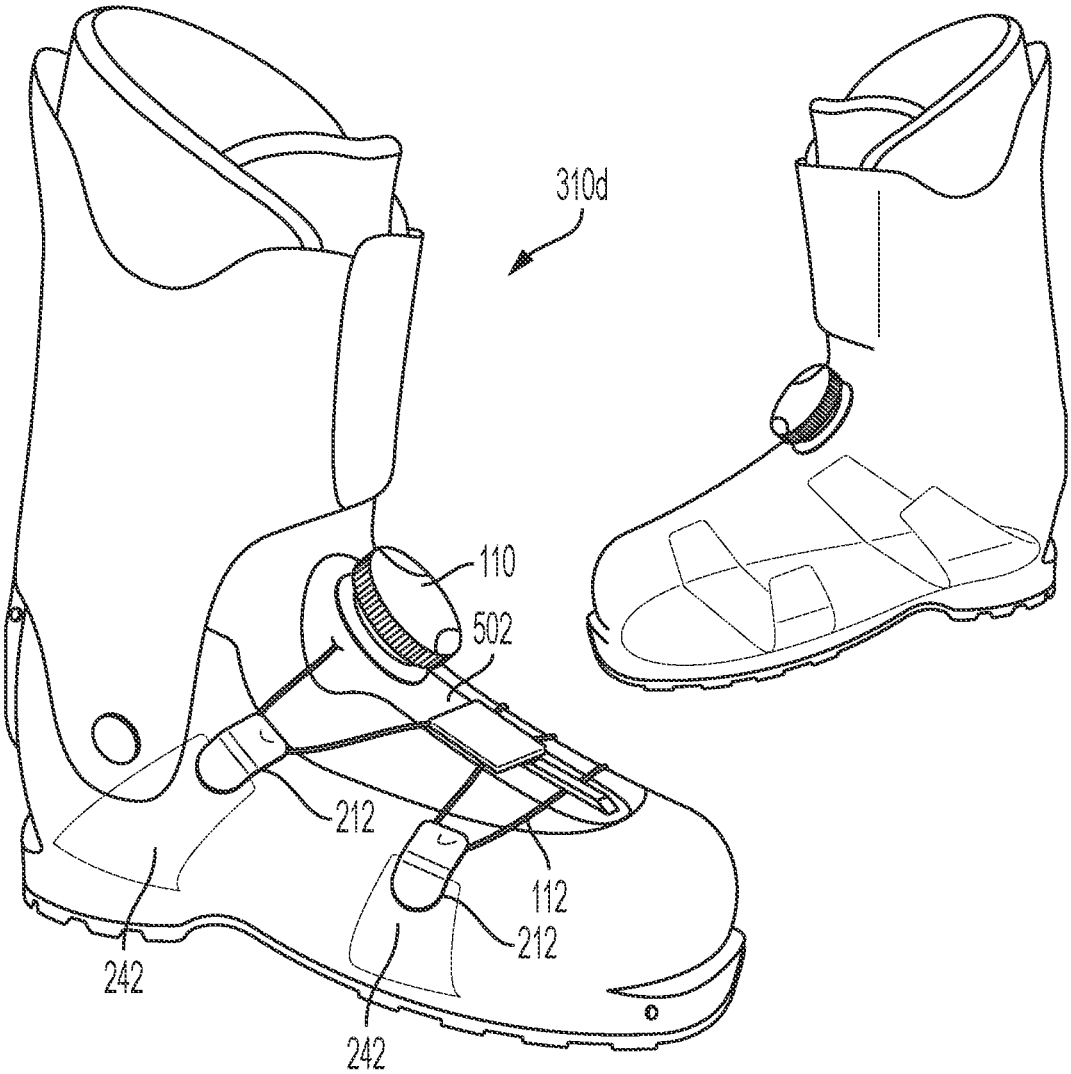

FIG. 6 illustrates a ski boot 310*d* that is substantially similar to the ski boot 310*c* illustrated in FIG. 5. The ski boot 310*d* of FIG. 6 includes the individual straps 242, but does not include a strap that is positioned around the wearer's ankle. Rather, the ski boot 310*d* includes a forefoot strap positioned toward a distal end of the toe box and a rearfoot strap that is positioned near the heel. In some instances, the rearfoot strap 242 may include a heel cup that surrounds and cushions the heel.

Figure 7:
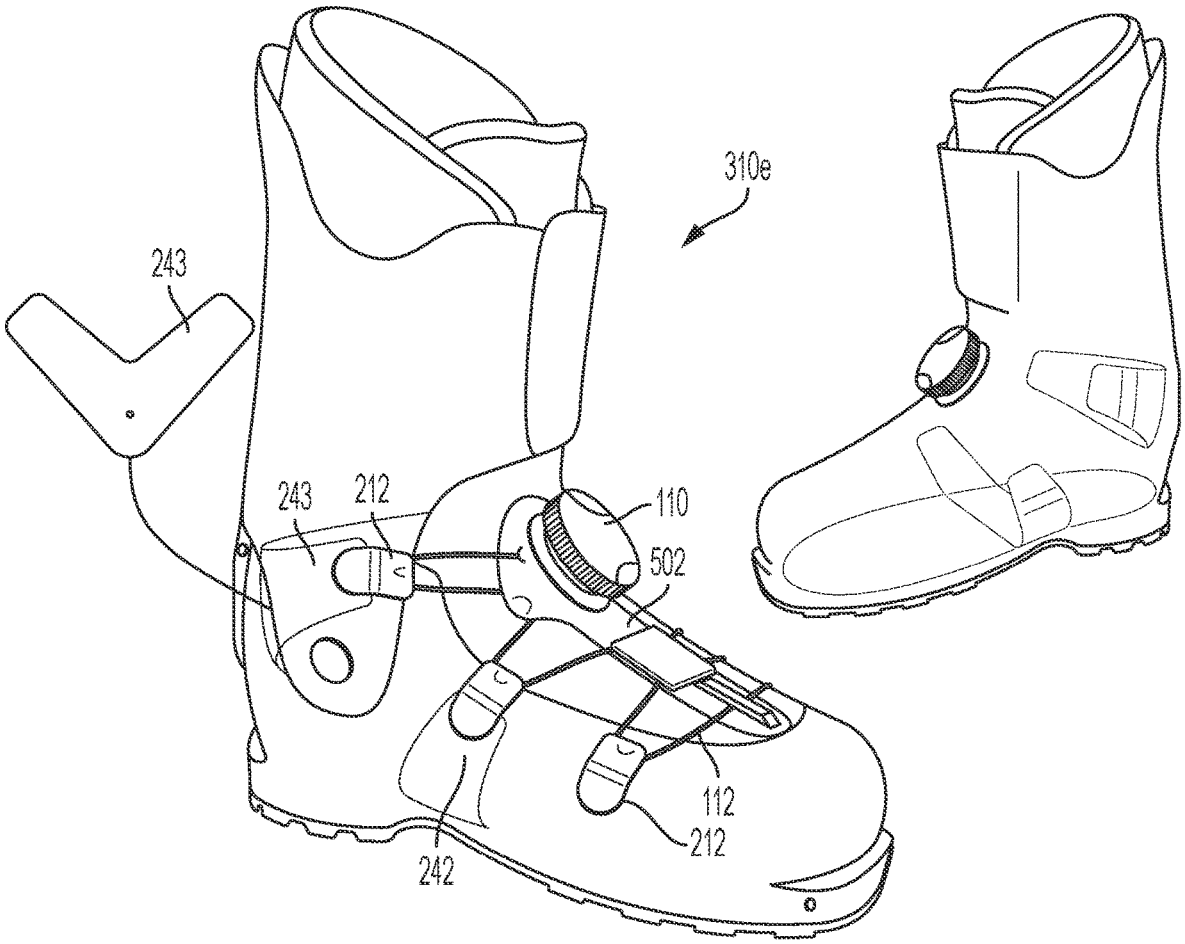

FIG. 7 illustrates a ski boot 310*e* that is substantially similar to the ski boot 310*c* and 310*d* illustrated in FIGS. 5 and 6, respectively. The ski boot 310*e* of FIG. 7 includes an individual strap 242 that is positioned toward the heel of the ski boot 310*e*. The ski boot 310*e* does not include the forefoot strap illustrated in FIG. 6, but does include an ankle strap 243 that is positioned around the wearer's ankle. The ankle strap 243 has a V-shaped configuration, which aids in wrapping the ankle strap 243 about the wearer's ankle. The ski boot 310*e* also includes a forward guide 212 that is not coupled with an individual strap, but is instead attached directly to the ski boot 310*e*.

Figure 8:
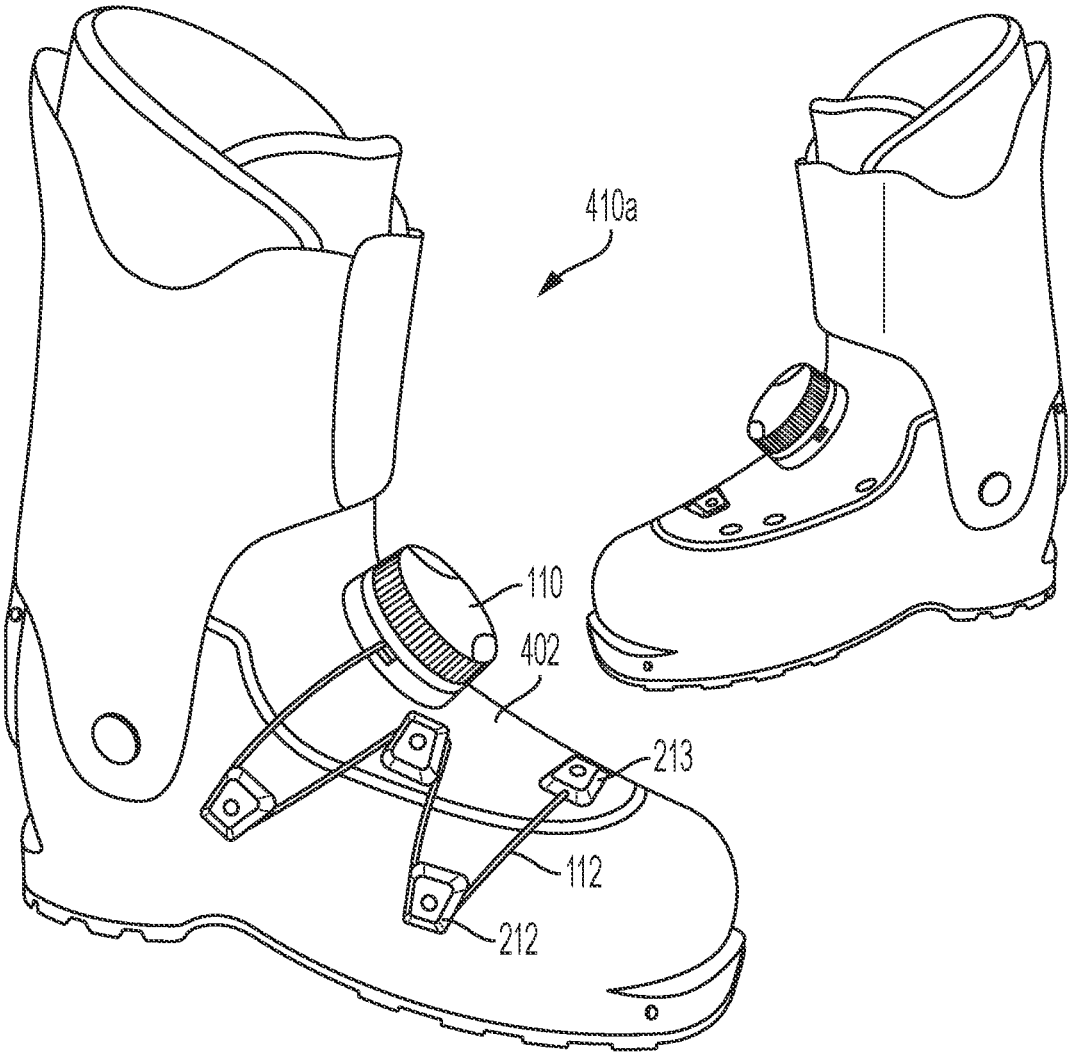

FIGS. 8-12 illustrate embodiments of ski boots that include reel based closure devices and guides that are positioned on the exterior of the ski boot. Referring to FIG. 8, illustrated is a ski boot 410*a* that includes a reel based closure device 110 attached to an upper portion 402 of the ski boot 410*a*. The reel based closure device 110 is operably coupled with a tension member 112 that is routed about the ski boot 410*a* via a plurality of guides 212 that function as described herein. In some embodiments, the upper portion 402 of the ski boot 410*a* is a flap or lateral extension of the ski boot's rigid outer shell. In other embodiments, the upper portion 402 of the ski boot 410*a* is a tongue of a cabrio style ski boot. The tongue of the cabrio style ski boot may be separate from the shell of the ski boot or attached at one or more positions along the tongue.

The ski boot 410*a* includes three guides 212 that route the lace between the reel based closure device 110 and the distal end of the ski boot's upper portion 402. Two of the guides 212 are positioned near the ski boot's sole on the exterior shell while a middle guide 212 is positioned on the ski boot's upper portion 402. The tension member 112 terminates at a termination guide 213 positioned on the distal end of the upper portion 402. The tension member 112 is routed or guided along the upper portion 402 and sole in a zig-zag manner between the reel based closure device 110 and the termination guide 213. The tension member 112 forms a "W" shape along its lace path about the ski boot 410*a*.

Figure 9:
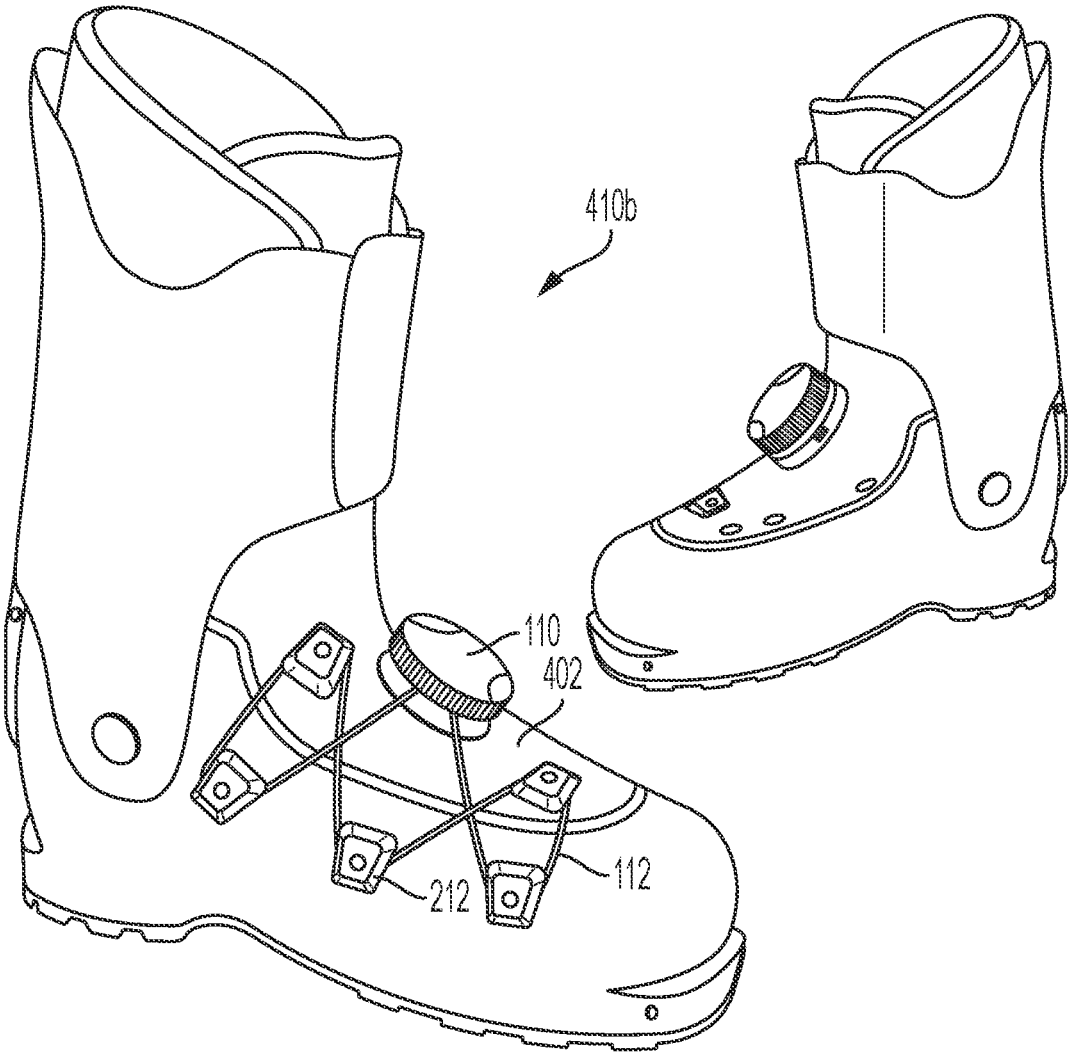

FIG. 9 illustrates a ski boot 410*b* having a similar construction to the ski boot 410*a* illustrated in FIG. 8. Specifically, the reel based closure device 110 and one or more guides 212 are positioned on the upper portion 402 of the ski boot 410*b*. The ski boot 410*b* of FIG. 9 differs in the lace path of the tension member 112. The lace path is oriented so that the reel based closure device 110 is positioned at a mid-point of the lace path. Opposing ends of the tension member 112 are operably coupled with the reel based closure device 110 so that operating the reel based closure device 110 simultaneously tensions both ends of the tension member 112.

The lace path includes a pair of guides 212 that are positioned proximally of the reel based closure device 110 and a pair of guides 212 that are positioned distally of the reel based closure device 110. Each of the pair of guides includes an upper guide that is positioned on the upper portion 402 of the ski boot 410*b* and a lower guide that is positioned on the shell toward the sole. The lace path may include an additional guide (not shown) or guide pair (not shown) that is positioned proximally and/or distally of the reel based closure device 110 as desired. A mid-guide 212 is positioned laterally below the reel based closure device 110 on the shell.

Figure 10:
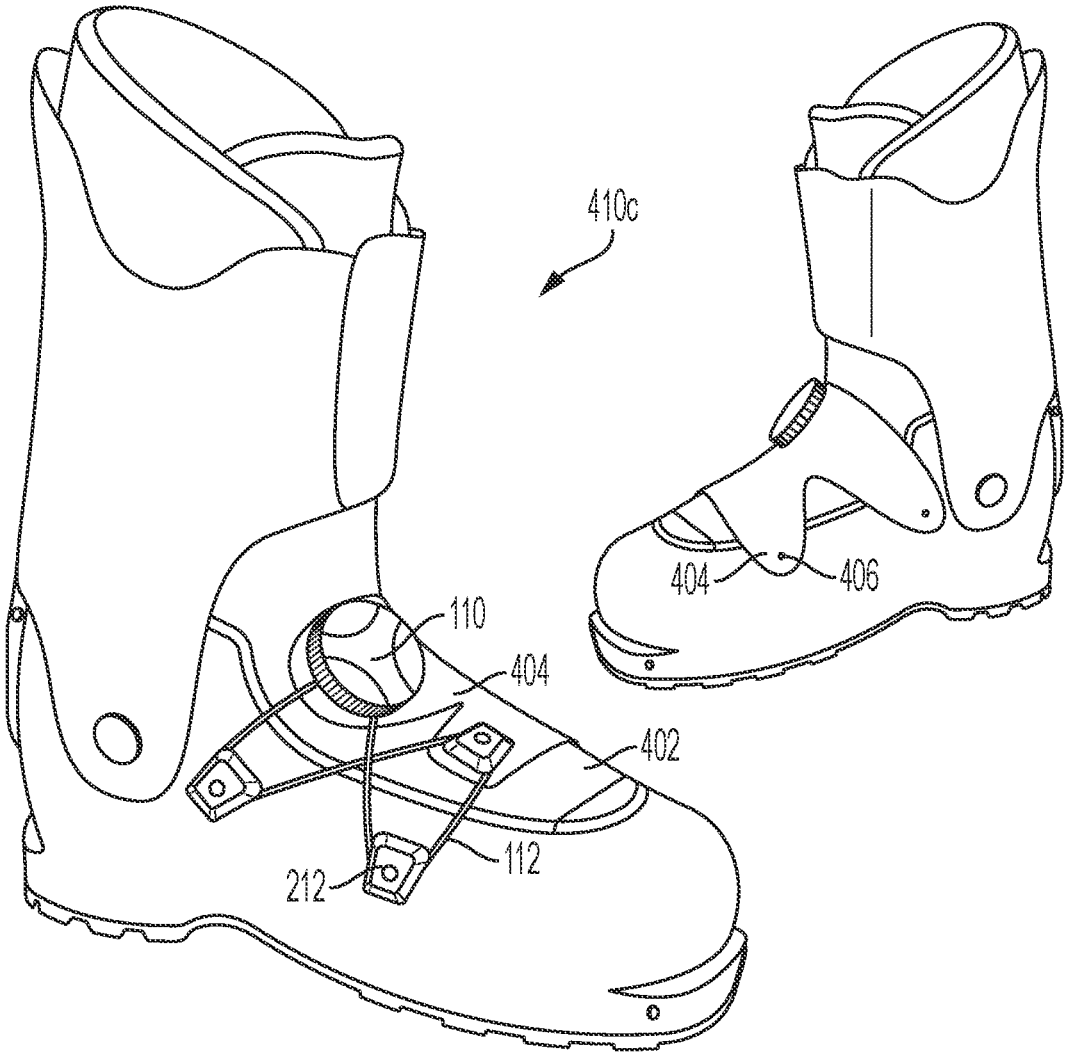

FIG. 10 illustrates a ski boot 410*c* that includes the reel based closure device 110 and one or more guides 212 positioned atop the upper portion 402 of the ski boot 410*c*. In contrast to the ski boots of FIGS. 8 and 9, the ski boot 410*c* of FIG. 10 includes a panel 404 that is positioned atop the ski boot's upper portion 402. A proximal end of the panel 404 is coupled with the ski boot's shell via one or more coupling means, such as rivets, adhesives, mechanical fasteners, welding, and the like. In a specific embodiment, the proximal end of the panel 404 may include a plurality of coupling means, such as two rivets illustrated in FIG. 10. The distal end of the panel 404 may be "free floating" atop the upper portion 402, which means that the distal end of the panel 404 may move or pivot about the upper portion 402 to some degree.

The reel based closure device 110 and at least one guide 212 are attached to the distal end of the panel 404, or near the distal end of the panel 404. In some embodiments, the panel 404 may include a laterally oriented gap that is positioned between the reel based closure device 110 and a guide 212 that is attached to the panel 404. The panel may similarly include a laterally oriented gap that is positioned on the proximal end between the coupling points. The laterally oriented gaps may extend in opposite directions from the proximal and distal ends or edges of the panel 404. The laterally oriented gaps, or one of the gaps, may increase the flexibility of the panel 404, which may allow the panel 404 to easily adapt to the upper portion 402 as the tension member 112 is tensioned.

In the specific embodiment illustrated in FIG. 10, the lace path is defined by a pair of lower guides 212 that are positioned on the ski boot's shell and an upper guide 212 that is attached to the panel 404. The tension member 112 is routed from the reel based closure device 110 to one of the lower guides and is routed therefrom to the upper guide positioned on the panel 404. From the upper guide, the tension member is routed to the other lower guide on the shell and then back to the reel based closure device 110. This routing of the tension member 112 forms a figure eight atop the ski boot 410*c*.

Figure 11:
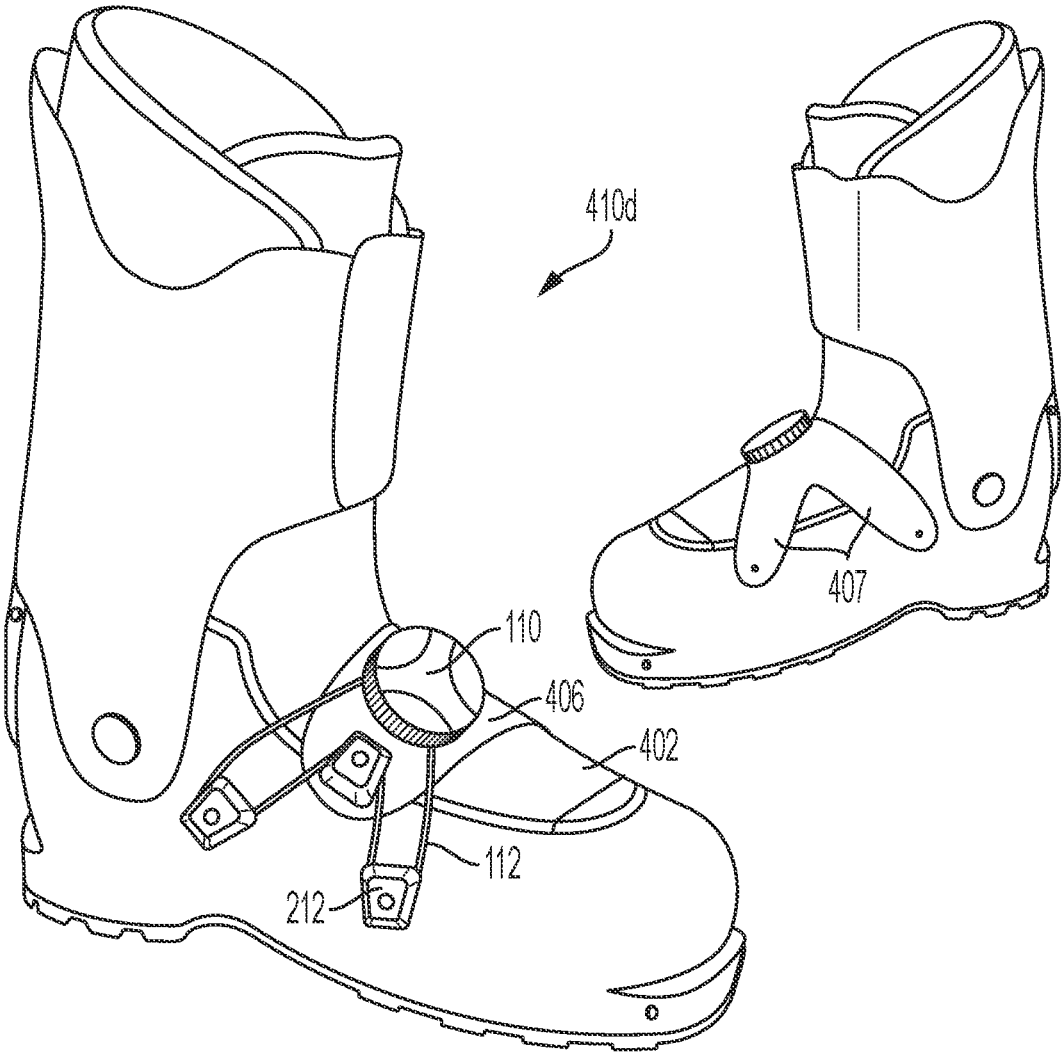

FIG. 11 illustrates a ski boot 410*d* in which the reel based closure device 110 and one or more guides 212 are attached to a panel 406 that is positioned atop the upper portion 402 of the ski boot 410*d*. A proximal end of the panel 406 has a V-shaped configuration with a pair of arms 407 that are each coupled with the ski boot's shell via one or more coupling means, such as rivets, adhesives, mechanical fasteners, welding, and the like. The arms 407, which are separated by a lateral gap, may form an angle between 60 and 120 degrees and more commonly between 75 and 105 degrees. The distal end of the panel 406, which narrows from the arms 407 to a curved distal tip, is "free floating" atop the upper portion 402 of the ski boot 410*d*. A pair of guides 212 are attached to the ski boot's shell so that the lace path forms a V-shaped path on the side of the ski boot 410*d*.

Figure 12:
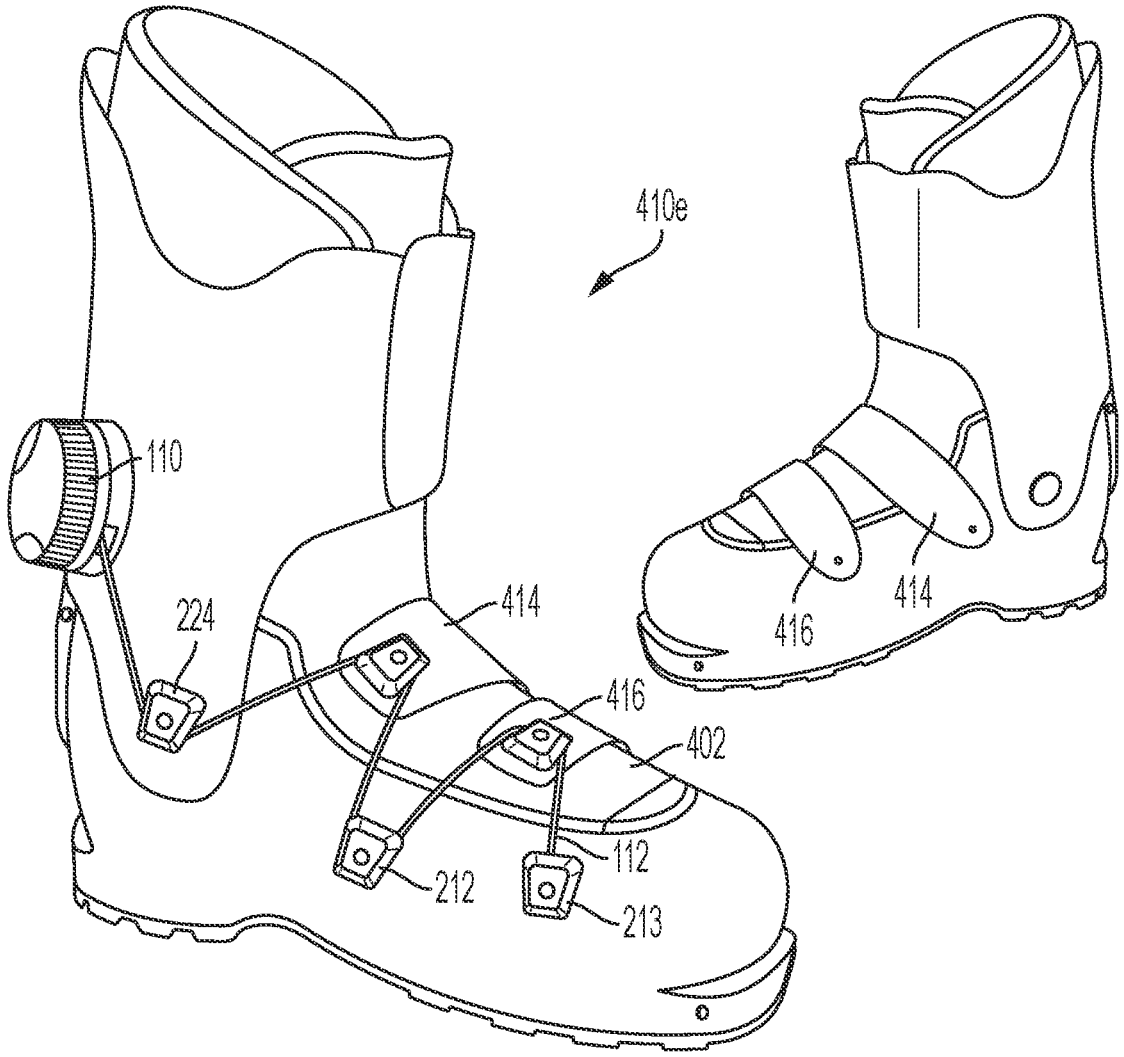

FIG. 12 illustrates a ski boot 410*e* that includes a plurality of straps, 414 and 416, that are positioned atop the longitudinal opening or tongue of the ski boot 410*e*. A proximal end of each strap, 414 and 416, is attached to the ski boot 410*e* while a distal end of each strap, 414 and 416, includes a guide that is operably coupled with the tension member 112 in order to route or direct the tension member along a lace path. A middle guide member 212 is attached to the ski boot 410*e* between the straps, 414 and 416, and a termination guide 213 is positioned at the end of the lace path. A distal end of the tension member 112 is coupled with, and terminates at, the termination guide 213. The ski boot 410*e* also includes an upper guide 224, which in some embodiments may be positioned at or near the pivot joint of the ski boot 410*e*. The reel based closure device 110 is positioned on the upper cuff so as to be easily accessible to the wearer.

Figure 13A:
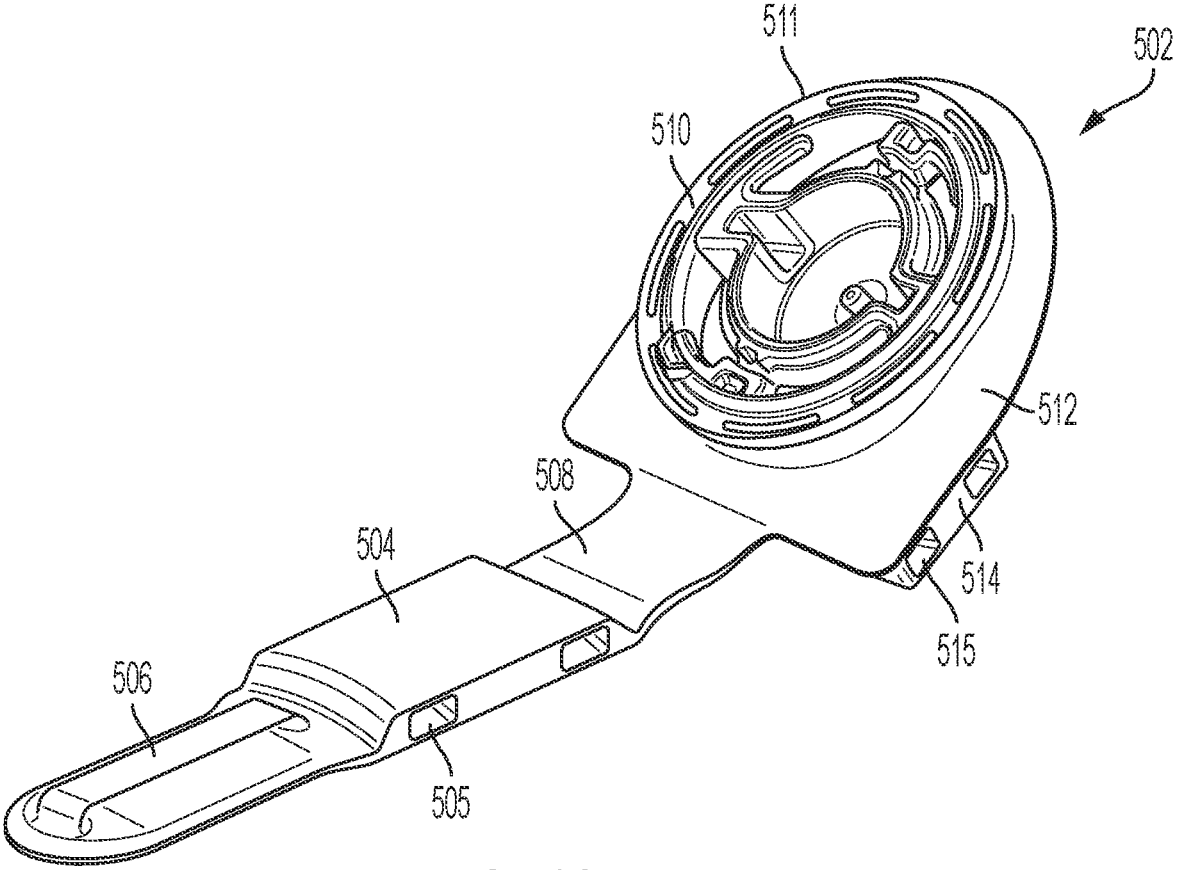

Referring to FIG. 13A, illustrated is an embodiment of an elongate panel 502 that may be used with many of the ski boot embodiments described herein. As with the elongate panels previously described, the elongate panel 502 of FIG. 13 is designed to be positioned or oriented between opposing sides of a longitudinal opening of the ski boot. However, the elongate panel 502 is configured to be positioned internally within the exterior of the ski boot so that only a portion or component of the elongate panel 502, such as the reel based closure device (not shown), is positioned on the exterior of the ski boot. In a specific embodiment, the elongate panel 502 is designed to be positioned under a gaiter or external covering that is positioned atop the ski boot's longitudinal opening.

Figure 13B:
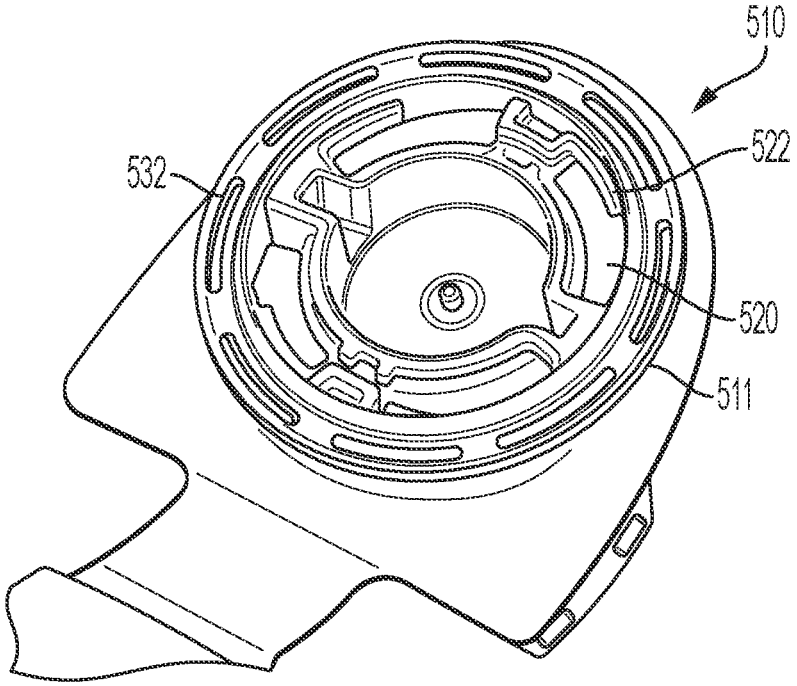

A proximal end of the elongate panel 502 includes a base member 510 or bayonet (hereinafter base member 510) that is configured to detachably couple with the reel based closure device (not shown). As shown in FIG. 13B, the base member 510 includes a plurality of circumferentially oriented openings 520 that each include an axially inward projecting tab 522. The tab 522 reduces a width of the opening 520. The opening 520 is designed so that corresponding tabs or projections of the reel based closure device may be axially inserted into the openings 520 and the reel based closure device rotated to position the tabs or projections of the reel based closure device under the tabs 522 of the base member 510. Positioning the reel based closure device's tabs or projections under the base member's tabs 522 locks the reel based closure device within the base member 510 by preventing the reel based closure device from being axially withdrawn or extracted from the base member 510. A detailed description of a similar type detachable base member and reel based closure device is provided in U.S. application Ser. No. 15/836,475, filed Dec. 8, 2017, entitled "Reel Based Closure System", the entire disclosure of which is incorporated by reference herein.

The proximal end of the elongate panel 502 also includes a flange or wing 512 (hereinafter flange 512) that circumferentially surrounds the base member 510. A width of the flange 512 may vary around the perimeter of the base member 510. For example, the width of the flange 512 may be narrow at the proximal end of the elongate panel 502 and may widen as the flange 512 extends distally around the base member 510. In such instances, an outer periphery of the flange 512 may have a U-shape around the base member 510. The flange 512 is configured for positioning under the exterior of the ski boot, such as under a gaiter or external covering of the longitudinal opening.

Figure 13C:
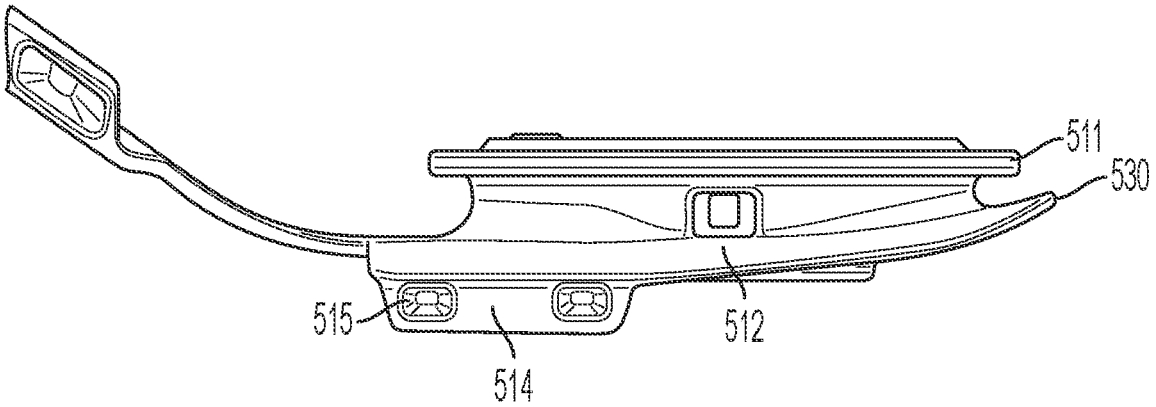
Figure 13D:
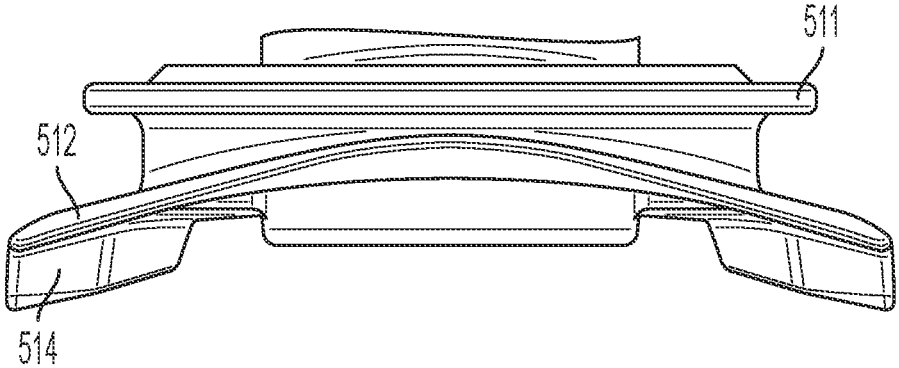

As shown in FIGS. 13C-D, opposing sides of the flange 512 may curve downward, which shape may accommodate placement of the gaiter or external covering over the flange 512. In some instances, the flange 512 may have an upward curved distal tip 530. The upward curved distal tip 530 may increases a wearer's comfort by not pressing on the user's foot when the ski boot is tightened and worn. The distal tip 530 may be separated from an annular ring 511 by at least 2 mm in order to allow the gaiter material to be inserted between the distal tip 530 and ring 511.

The annular ring 511 extends circumferentially around the base member 510 and defines an outer periphery or perimeter of the base member 510. The ring 511 may extend entirely or partially around the base member 510 as desired. Similarly, the ring 511 may be a continuous ring or may be constructed or multiple arched or curved segments that together define the ring 511. The ring 511 is designed to maintain an orientation of the elongate panel 502 about the gaiter (not shown). Specifically, the gaiter may include a hole or aperture through which the base member 510 is inserted. The ring 511 is configured so that it is slightly larger in diameter than the hole in the gaiter, which allows the gaiter to be slipped over the ring 511 and fit secure below the ring 511 and above the flange 512. The wider diameter ring 511 and tight fit of the gaiter about the base member 510 aids in preventing water or other debris from entering the ski boot through the hole in the gaiter.

In some embodiments, the ring 511 includes one or more circumferentially oriented slots 532 positioned between an inner and outer wall of the ring 511. The ring 511 typically includes a plurality of circumferentially oriented slots 532 that are equally spaced apart so as to extend around the circumference of the ring 511. The circumferentially oriented slots 532 help ensure that the base member 510 is not over constrained when the reel based closure device is coupled with the base member 510. The circumferentially oriented slots 532 also aid in detachment of the reel based closure device from the base member 510 due to a substantial impact of the reel based closure device with an external object. The circumferentially oriented slots 532 may allow the base member 510 and/or ring to deform to some degree, which may aid in detachment of the reel based closure device from the base member as a result of a substantial impact that would otherwise damage the reel based closure device or elongate panel 502.

Figure 13E:
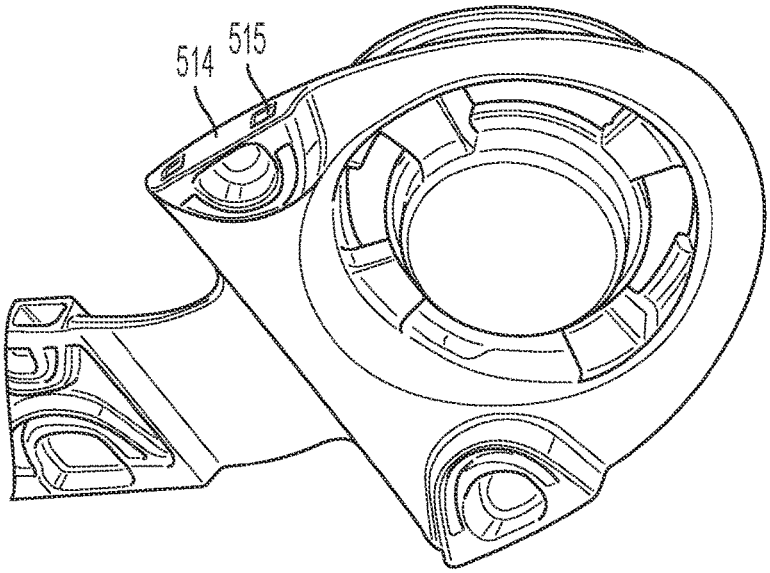
Figure 13F:
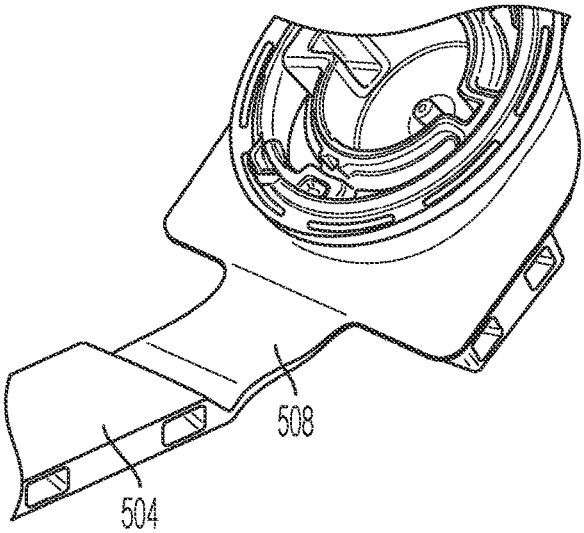
Figure 13G:
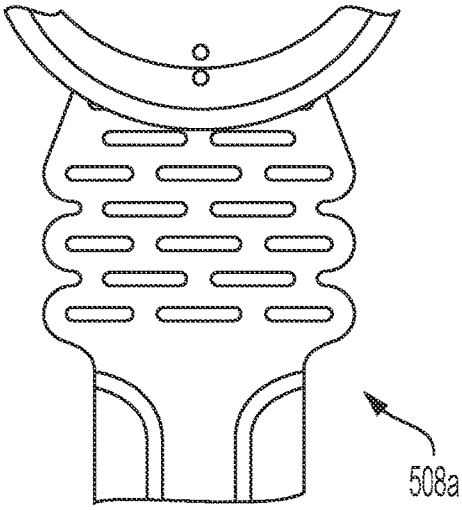

As illustrated in FIG. 13E, an upper guide 514 is formed under the flange 512. The upper guide includes lace openings 515 that allow the tension member to enter and exit the guide 514. An arcuate channel is formed between the lace openings 515, which routes or guides the tension member between the openings 515. The upper guide 514 is configured to route or direct a tension member between a guide (not shown) positioned on an upper end of the lace path.

A midsection 504 of the elongate panel 502 also includes guide members that are configured to route or direct the tension member along the lace path. The guide members are formed in a main body of the midsection 504 and are arranged or oriented so that the tension member is guided or directed toward opposing sides of the ski boot. In some instances, a single guide member may be used in place of separate guide members in the midsection 504. The single guide member may have opposing channels or openings that route or direct the tension member to the respective opposing sides of the ski boot. The guide members of the midsection 504 have a pair of openings 505 through which the tension member is positioned. An arcuate channel connects the two openings 505 and routes or directs the tension member between the openings 505. The arcuate channel may have a configuration similar to the upper guide 514 illustrated in FIG. 13E.

A distal end 506 of the elongate panel 502 extends distally from the midsection 504. The distal end 506 includes a centrally located guide member that functions to guide or direct the tension member across and atop the distal end 506 of the elongate panel 502. The centrally located guide of the distal end 506 may have a longitudinal length that is approximately equal to a longitudinal length of the distal end 506 as illustrated. In some embodiments, the distal end 506 and midsection 504 of the elongate panel 502 may have a width that is substantially the same. Stated differently, the width of the midsection 504 and distal end 506 may be roughly the same. The width of these sections may be substantially narrower than a width of the proximal end as illustrated in FIG. 13A. The midsection 504 may be thicker than the distal end 506 due to the formation of the guide within the midsection 504.

A neck 508 connects the proximal end and midsection 504 of the elongate panel 502. The neck 508 extends from a distal end of the flange 512 to the midsection. The neck 508 may have a width that is similar or substantially the same as the midsection 504. However, the neck 508 is typically thinner than the midsection 504. The neck 508 forms a flex zone that allows the elongate panel 502 to orient across the flex zone of the wearer's foot. Specifically, the neck 508 is designed to flex as the wearer walks in the ski boot. For example, some ski boots are designed to have a "walk mode" that allows the wearer to easily walk in the boot. The neck 508 allows the elongate panel 502 to bend and flex with the foot when the ski boot is configured in the walk mode. More specifically, the neck 508 allows the proximal end, including the base member 510 and reel based closure device, to flex and move in relation to the midsection 504 and distal end 506 of the elongate panel 502. The proximal end of the elongate panel 502 is commonly positioned near the ankle where the foot curves upward toward the leg. As such, it may be desirable to allow the proximal end to flex and move to a greater degree relative to the midsection 504 and distal end 506.

The neck 508 is typically a flat and thin component, which minimizes stress. In a specific embodiment, the neck 508 may have a thickness of between 1 mm and 4 mm, and more commonly between 1 mm and 3 mm, or 1 mm and 2.5 mm. These thicknesses were found to provide an optimal level of structure and flexibility. Thicknesses beyond this claimed range may be prone to fatigue failure due to increased stress. In some instances, the neck 508 may have a uniform width and thickness between the flange 512 and midsection 504. In other embodiments, the neck 508 may have a "kerf" design or pattern 508*a* (see FIG. 13G), which enables the neck 508 to easily bend and flex. The "kerf" design or pattern 508*a* may minimize stress by converting bending stress into torsional stress, which may result in twisting of individual section or beams of the "kerf" design or pattern 508*a* to enable the flex, movement, or displacement of the neck 508. In yet other embodiments, the neck 508 may have a tapering width and/or thickness, which may allow the neck 508 to be designed to have a combination of increased stiffness in certain areas and increased flex in other areas. The neck 508 may also be formed of a material that is more elastic or flexible in comparison with a material of the remainder the elongate panel 502. The neck 508 may have any combination of uniform thickness, kerf design, material selection, and/or tapering width and thickness in select areas to achieve a desired result.

While the elongate panel 502 is illustrated as a single component, in some embodiments the elongate panel 502 may be constructed of multiple pieces or components. For example, the neck 508 of the elongate panel 502 may be constructed of a two or three piece hinge. The ring 511 may be a separate component that is snapped or bolted on the base member 510. The use of a separate ring 511 may lock the base member 510 to the gaiter or outer covering more securely. In other instances, the ring 511 may be formed on a portion of the reel based closure device's housing (not shown) so that the ring 511 and base member 510 attach together as the reel based closure device is coupled with the base member 510. Similarly, the flange 512 may be a separate component that snaps or coupled directly onto the base member 510. In other embodiments, the proximal end of the elongate panel 502 may be a separate piece from the midsection 504 and/or distal end 506. In such embodiments, the proximal end may be attached to the midsection 504 and/or distal end 506 using mechanical fasteners and/or the tension member. In other embodiments, the proximal end may remain separate from the midsection 504 and/or distal end 506, which would eliminate the need for the neck 508.

Figure 14A:
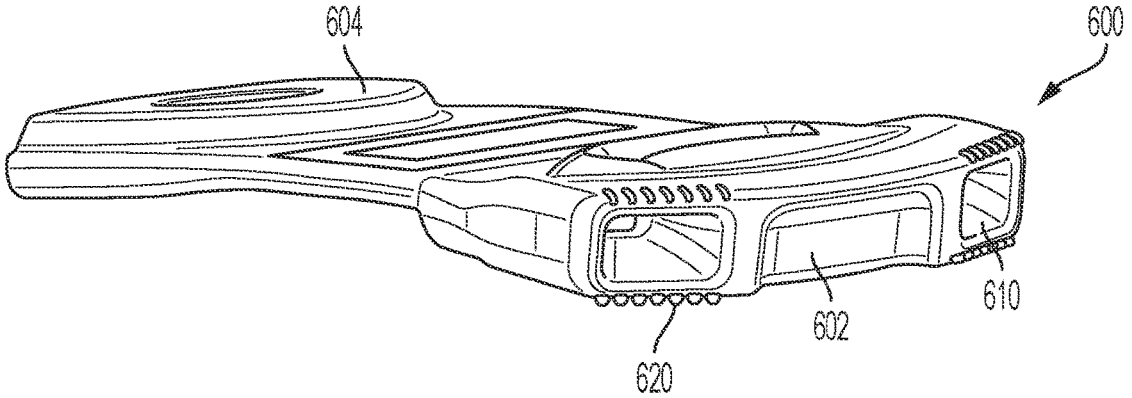
Figure 14B:
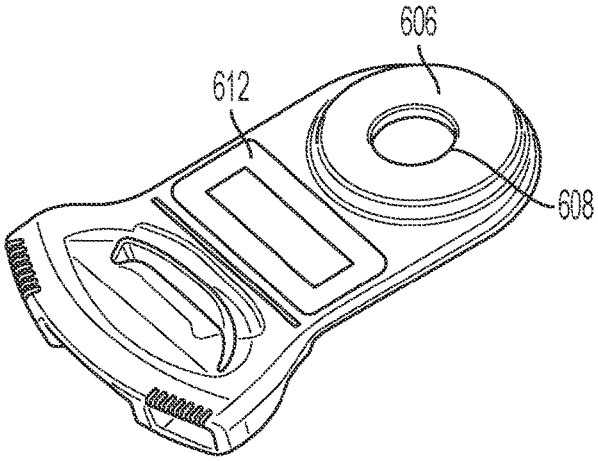
Figure 14C:
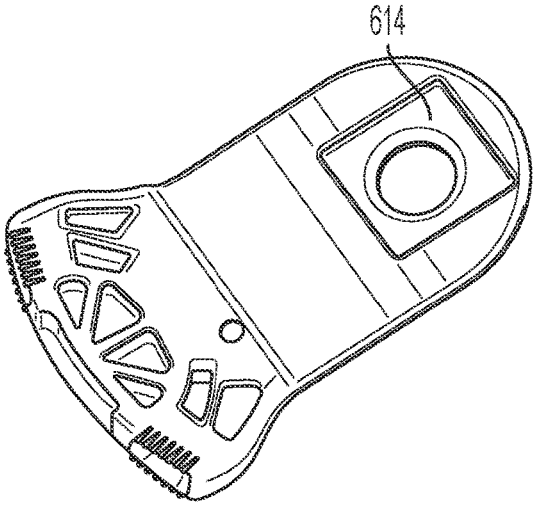

Referring to FIGS. 14A-C, illustrated is an embodiment of a guide 600 that may be used to route or guide a tension member about a ski boot. The guide 600 may be used with any of the embodiments described herein. The guide 600 is designed to be hidden from external view if installed on the inside of the ski boot. When guides are installed on the inside of the ski boot, replacing the tension member may be difficult. As described herein below, to aid in replacing the tension member, the guide 600 includes indicia that helps the wearer identify the lace openings or ports through which the tension member is positioned. In other instances, the guide 600 may be externally mounted on the ski boot, which would render the guide 600 externally visible.

The guide 600 includes a proximal end 602 and a distal end 604. Lace openings or ports 610 are formed on the proximal end 602 of the guide 600. An arcuate channel connects the two openings 610 formed on the proximal end 602. The arcuate channel routes or directs the tension member between the two openings 610. The distal end 604 includes an aperture or hole 608 (hereinafter aperture 608) that is configured to receive a mechanical fastener, such as a rivet or bolt. The mechanical fastener (not shown) may be inserted through the aperture 608 and fastened to the ski boot. The distal end includes a smooth surface 606 that circumferentially surrounds the aperture 608. The smooth surface 606 is designed to contact an inner surface of the ski boot's shell. The smooth surface 606 may have an annular shape as illustrated or any other shape desired.

An surface or face of the distal end 604 that is opposite the smooth surface 606 may have a recessed chamber or deboss 614 that is configured to accommodate a mechanical fastener, such as a T-Nut base. The recessed chamber 614 is shaped and sized so that the mechanical fastener (e.g., T-Nut base) fits inside of this chamber 614. In some instances, the chamber 614 may have a chamfer to enable a better fit with the mechanism fastener, such as a fillet at the base of a T-Nut.

The guide 600 includes a mid-section 612 that is thinner than the proximal end 602 and distal end 604. The thinner mid-section 612 is configured so that the mid-section 612 functions as a stitch area, which provides the guide 600 with an alternative attachment means. For example, the mid-section 612 enables the guide 600 to be stitched directly to the ski boot, or attached to a strap or panel as illustrated in many of the embodiments described herein. The mid-section 612 may have a pattern, such as a rectangular shaped recess, that visually indicates where the stitching should be applied.

At least one of the lace openings 610, and typically both lace openings, include haptic texture 620 that aids the wearer in identifying a position of the lace openings 610. More specifically, the haptic texture 620 helps the wearer identify the lace openings 610 by feeling or sensing the openings 610 rather than by visually seeing the openings 610. Identifying the openings 610 in this manner is important when the guides 600 are positioned within the ski boot since the ski boot blocks or impedes a view of the openings 610. In such instances, the wearer can rely on the sense of touch to easily locate the openings 610 and insert the tension member through the openings during lace replacement. The haptic texture 620 may be ribs that are formed in one or more surfaces of the guide's proximal end 602. The haptic texture 620 is positioned in a location where the tension member will not contact the haptic texture 620 (e.g., ribs) and abrade or wear, which would negatively impact the function and life of the tension member. In the illustrated embodiment, haptic texture (e.g., ribs) are formed on both the upper and lower surfaces of the openings 610. The haptic texture (e.g., ribs) is formed on these surfaces so that the texture does not extend into the openings and into contact with the tension member. In some embodiments, the haptic texture (e.g., ribs) may be formed on either an upper or lower surface rather than on both surfaces.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A tightening device for tightening a ski boot, the tightening device comprising:

an elongate panel having a proximal end and a distal end, the elongate panel being positionable about a shell of the ski boot between opposing sides of the shell;

a tensioner that is coupled with the proximal end of the elongate panel, the tensioner comprising a knob;

a tension member that is operably coupled with the tensioner so that a rotation of the knob adjusts a tension of the tension member; and at least one guide member that is coupled with, or positioned on, the proximal end of the elongate panel adjacent the tensioner;

wherein the proximal end of the elongate panel includes an annular ring that is positioned above the elongate panel to allow a gaiter of the ski boot to be positioned between the elongate panel and the annular ring such that only the tensioner is positioned externally of the gaiter; and wherein the tension member is coupled with the at least one guide member so that the tension member is routed between the opposing sides of the shell and along a portion of the elongate panel.

2. The tightening device of claim 1, wherein the at least one guide member includes a first guide member positioned on a first side of the elongate panel and a second guide member positioned on a second side of the elongate panel opposite the first side.

3. The tightening device of claim 2, wherein the first guide member and the second guide member are positioned on arms or tabs that extend laterally from opposing sides of the proximal end of the elongate panel.

4. The tightening device of claim 1, wherein the elongate panel further comprises a second guide member that is positioned along the elongate panel between the proximal end and a distal end of the elongate panel.

5. The tightening device of claim 4, wherein the elongate panel is laterally wider or flared adjacent the second guide member.

6. The tightening device of claim 4, wherein the tension member is routed longitudinally along a center portion of the elongate panel via the second guide member such that the tension member does not cross itself along the center portion of the elongate panel.

7. The tightening device of claim 1, wherein the tension member is operably coupled with one or more straps, panels, or material segments that are positioned under an outer shell of the ski boot and that engage a liner of the ski boot.

8. The tightening device of claim 7, wherein the straps, panels, or material segments form or define an internal harness that is positioned under the outer shell of the ski boot.

9. The tightening device of claim 1, wherein at least a portion of the proximal end of the elongate panel curves downward to accommodate placement of the gaiter between the elongate panel and the annular ring.

10. The tightening device of claim 1, wherein the elongate panel includes a flexible member or zone that connects the proximal end of the elongate panel to a distal end of the elongate panel, the flexible member or zone allowing the proximal end of the elongate panel to bend and flex relative to the distal end.

11. The tightening device of claim 10, wherein the flexible member or zone is a thin material section, a hinge, or a kerf section.

12. The tightening device of claim 1, wherein the elongate panel is not attached to the shell other than via the tension member.

13. The tightening device of claim 1, wherein the tensioner is removably coupled with the proximal end of the elongate panel.

14. The tightening device of claim 1, wherein the proximal end of the elongate panel is substantially wider and thicker than the distal end of the elongate panel.

15. A method of coupling a tightening device with a shell of a ski boot, the method comprising:

providing the tightening device, the tightening device including:

an elongate panel having a proximal end and a distal end, the elongate panel being positionable about the shell of the ski boot between opposing sides of the shell;

a tensioner that is coupled with the proximal end of the elongate panel, the tensioner comprising a knob;

a tension member that is operably coupled with the tensioner so that a rotation of the knob adjusts a tension of the tension member; and at least one guide member that is coupled with, or positioned on, the proximal end of the elongate panel adjacent the tensioner;

wherein the proximal end of the elongate panel includes an annular ring that is positioned above the elongate panel to allow a gaiter of the ski boot to be positioned between the elongate panel and the annular ring such that only the tensioner is positioned externally of the gaiter;

wherein the tension member is coupled with the at least one guide member so that the tension member is routed between the opposing sides of the shell and along a portion of the elongate panel;

positioning the tightening device between opposing sides of the shell;

attaching the tension member to a first guide on a first side of the shell;

attaching the tension member to a second guide on a second side of the shell; and positioning a gaiter of the ski boot between the elongate panel and the annular ring such that only the tensioner is positioned externally of the gaiter.

16. The method of claim 15, wherein the at least one guide member includes a first guide member positioned on a first side of the elongate panel and a second guide member positioned on a second side of the elongate panel opposite the first side, and wherein the first guide member and the second guide member are positioned on arms or tabs that extend laterally from opposing sides of the proximal end of the elongate panel.

17. The method of claim 15, wherein the elongate panel further comprises a second guide member that is positioned along the elongate panel between the proximal end and a distal end of the elongate panel, and wherein the tension member is routed longitudinally along a center portion of the elongate panel via the second guide member such that the tension member does not cross itself along the center portion of the elongate panel.

18. The method of claim 15, wherein the tension member is operably coupled with one or more straps, panels, or material segments that are positioned under an outer shell of the ski boot and that engage a liner of the ski boot.

19. The method of claim 18, wherein the straps, panels, or material segments form or define an internal harness that is positioned under the outer shell of the ski boot.

20. The method of claim 15, wherein the elongate panel includes a flexible member or zone that connects the proximal end of the elongate panel to a distal end of the elongate panel, the flexible member or zone allowing the proximal end of the elongate panel to bend and flex relative to the distal end.

21. The method of claim 15, wherein the elongate panel is not attached to the shell other than via the tension member.

22. The method of claim 15, wherein the tensioner is removably coupled with the proximal end of the elongate panel.

23. The method of claim 15, wherein the proximal end of the elongate panel is substantially wider and thicker than the distal end of the elongate panel.

* * * * *